US006550621B2

(12) United States Patent
Fukatsu et al.

(10) Patent No.: US 6,550,621 B2
(45) Date of Patent: Apr. 22, 2003

(54) PAPER-LIKE MATERIAL PROCESSING APPARATUS, SWITCHBACK MECHANISM AND PAPER-LIKE MATERIAL PROCESSING APPARATUS EQUIPPED WITH SWITCHBACK MECHANISM

(75) Inventors: Kunio Fukatsu, Kanagawa-ken (JP); Hiroshi Watanabe, Kanagawa-ken (JP); Yasuo Tsukada, Kanagawa-ken (JP); Sadao Sekine, Kanagawa-ken (JP); Hideaki Baba, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 2 days.

(21) Appl. No.: 09/814,925

(22) Filed: Mar. 23, 2001

(65) Prior Publication Data

US 2001/0028145 A1 Oct. 11, 2001

(30) Foreign Application Priority Data

Mar. 23, 2000 (JP) ..... 2000-082593
Aug. 18, 2000 (JP) ..... 2000-248892

(51) Int. Cl.[7] ..... B07C 5/00
(52) U.S. Cl. ..... 209/534; 271/228
(58) Field of Search ..... 209/534, 541; 194/230, 240; 271/226, 228, 253, 254, 255, 184, 185

(56) References Cited

U.S. PATENT DOCUMENTS 3,955,494 A * 5/1976 Suzuki ..... 101/232
4,520,932 A * 6/1985 Matsuda et al. ..... 209/545
4,629,382 A * 12/1986 Ueshin ..... 414/48
4,795,889 A * 1/1989 Matuura et al. ..... 235/186
4,856,768 A * 8/1989 Hiroki et al. ..... 271/186
5,034,781 A * 7/1991 Watanabe ..... 355/317
5,186,334 A * 2/1993 Fukudome et al. ..... 209/534
5,468,941 A * 11/1995 Sasaki ..... 235/379
5,755,437 A * 5/1998 Ek ..... 271/227
6,357,742 B1 * 3/2002 Ogasawara ..... 271/225
6,371,303 B1 * 4/2002 Klein et al. ..... 209/534

FOREIGN PATENT DOCUMENTS

JP 1-209247 A * 8/1989 ..... B65H/9/00
JP 3-26641 A * 2/1991 ..... B65H/9/16
JP 07-232847 9/1995

* cited by examiner

*Primary Examiner*—Donald P. Walsh
*Assistant Examiner*—Mark J Beauchaine
(74) *Attorney, Agent, or Firm*—Pillsbury Winthrop LLP

(57) ABSTRACT

A sheet processing apparatus is composed of: an insert portion into which the plural number of sheets are inserted in a lump; a conveying belt to convey the inserted sheets through a conveying path by one sheet at a time; a detector to detect directions of both sides and the top and bottom of sheets being conveyed through the conveying belt; a both side reversing mechanism to selectively reverse both sides of sheets conveyed by the conveying belt; a top and bottom reversing mechanism to selectively reverse the top and bottom of sheets being conveyed by the conveying belt; and stackers to sort and stack sheets that are aligned in the same direction by the both side reversing mechanism and the top and bottom reversing mechanism.

32 Claims, 21 Drawing Sheets

PAPER-LIKE MATERIAL PROCESSING APPARATUS, SWITCHBACK MECHANISM AND PAPER-LIKE MATERIAL PROCESSING APPARATUS EQUIPPED WITH SWITCHBACK MECHANISM

BACKGROUND OF THE INVENTION

1. Field of the Invention

The present invention relates to a paper-like material processing apparatus which sorts, makes directions of sheets, for example, bank notes in various kinds of nominal value which are inserted in a lump, and stacks them by kind of nominal value, a switchback mechanism which turns over the top and bottom of paper-like materials conveyed through a conveying path, and a paper-like material processing apparatus equipped with the switchback mechanism.

2. Description of the Related Art

So far, as an apparatus to process paper-like materials, for example, bank notes, an apparatus into which plural sheets of bank notes in plural kinds are input in a lump, kinds of bank notes are detected, sorted and stacked by kind, respectively has been known.

However, there was not available such an apparatus which sorts all inserted bank notes by kind of money and stacks bank notes by kind of money by aligning the direction. The direction of bank notes is in four types according to the both sides and the top and bottom.

To stack bank notes in various kinds of money by aligning the directions, four stackers are required for each kind of money and it was a problem that an apparatus would become large in size. For example, when kind of money of bank note is n kinds, n×4 stackers becomes necessary.

Further, an existing bank note processor is equipped with a switchback mechanism to reverse the leading and trailing edges along the conveying direction of bank notes.

The existing switchback mechanism has a stopper to stop the movement of a bank note being conveyed by striking its leading edge in the conveying direction and this stopped bank note is taken out and its top and bottom are turned over.

However, when a bank note being conveyed was stopped by striking its leading edge against the stopper as in the above-mentioned existing switchback mechanism, the bank note might be bent or damaged. When bank notes were bent or damaged, there were such problems that the jamming was caused in the switchback mechanism, the working ratio of the entire apparatus dropped and efficiency of process became worse.

Further, in a switchback mechanism of a type to stop a bank note by striking its leading edge to the stopper, unless a first bank note was once stopped and then sent out from the switchback mechanism, a next bank note cannot be accepted. Therefore, when plural bank notes are switch backed successively, it was necessary to make the bank note conveying intervals relatively long and to reduce the number of bank notes to be processed within a fixed time. Because of this, the number of bank notes that could be processed within a fixed time was restricted and process efficiency was worse.

SUMMARY OF THE INVENTION

An object of this invention is to provide a sheet processing apparatus capable of automatically making the directions of the front and back side and the top and bottom of bank notes uniform in the same direction, and sorting and stacking them.

In addition, another object of this invention is to provide a switchback mechanism that is able to switch back sheets surely and stably, process plural sheets continuously at a high speed and promote processing efficiency, and a sheet processing apparatus equipped with this switchback mechanism.

According to the present invention, a paper-like material processing apparatus is provided. The paper-like material processing apparatus comprises an insert port into which plural paper-like materials are inserted in a lump; a detector to detect the directions of front and back and top and bottom of paper-like materials that are conveyed one paper-like material at a time; and an aligning mechanism to align the front and back, and top and bottom of conveyed paper-like materials in the same direction based on the result of detection by the detector.

Further, according to this invention, a switchback mechanism is provided. The switchback mechanism comprises a conveying path to convey paper-like materials in a fixed direction; first and second switchback portions provided along the conveying path for reversing the top and bottom of a paper-like material by accepting the paper-like material conveyed through the conveying path and sending the paper-like material in the reverse direction; and a guide member to accept the paper-like materials conveyed through the conveying path in the first switchback portion and the second switchback portion selectively.

DETAILED DESCRIPTION OF THE PREFERRED EMBODIMENTS

Figure 1:
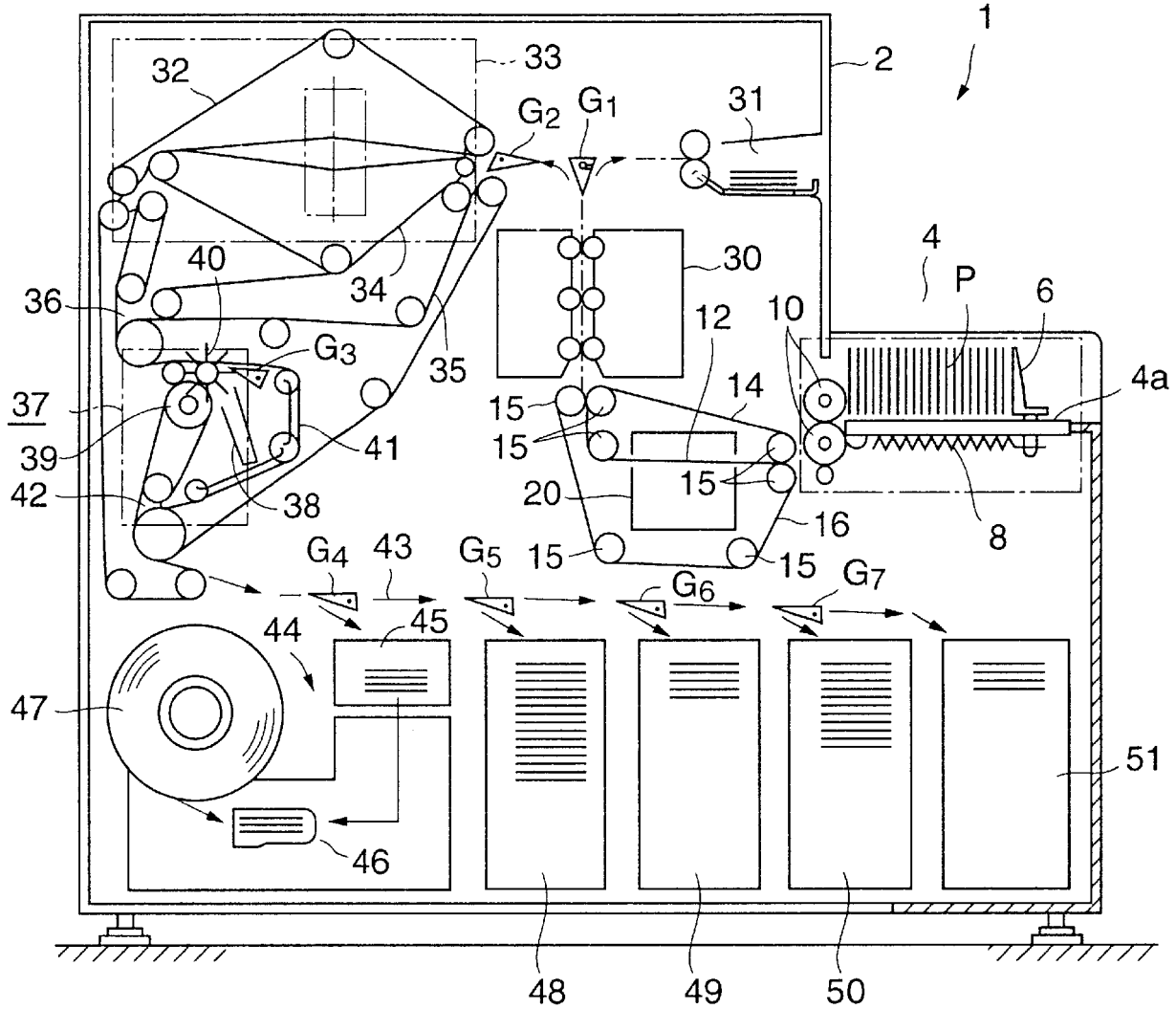
FIG. 1 is a schematic diagram showing the internal structure of a bank note processor as a first embodiment of the sheet processing apparatus of the present invention.

A bank note processor as a first preferred embodiment of the sheet processing apparatus of the present invention will be described below in detail referring to the drawings.

FIG. 1 shows the schematic internal structure of a bank note processor 1. The bank note processor 1 aligns all of plural bank notes in different kinds and sizes, which are inserted in mix and in a lump, in the same direction, sorts and stacks them by kind of money.

The bank note processor 1 has a housing 2 that is the outer block of the processor. On the stepped portion at the right side of the housing 2 shown in FIG. 1, an insert port 4 is provided to insert plural sheets of bank notes P gathered in the face direction in the erected state. This insert port 4 has a stage 4*a* to receive all bank notes P orderly by keeping in contact with its lower end. At the right end to the insert port 4 in FIG. 1, there is a backup plate 6 vertically erected against the stage 4*a*. This backup plate 6 is movable in the left direction along the stage 4*a* in FIG. 1 by the compression force of a spring 8.

Plural sheets of bank note P inserted into the insert portion 4 in the erected state is pressed in its face direction by the backup plate 6 and moved in the left direction in FIG. 1. Then, the bank note P at the left end is pressed against two sets of take-out rollers 10 which are arranged in the state vertically contacted each other at the left end to the insert portion 4. When the take-out rollers 10 are rotated in the specified direction, plural sheets of bank notes P inserted in the erected state into the insert portion 4 are taken out in order on a conveying path 12 from a bank note at the left end. In this embodiment, the bank note P is taken out with the upside down from the insert portion 4.

Figure 2:
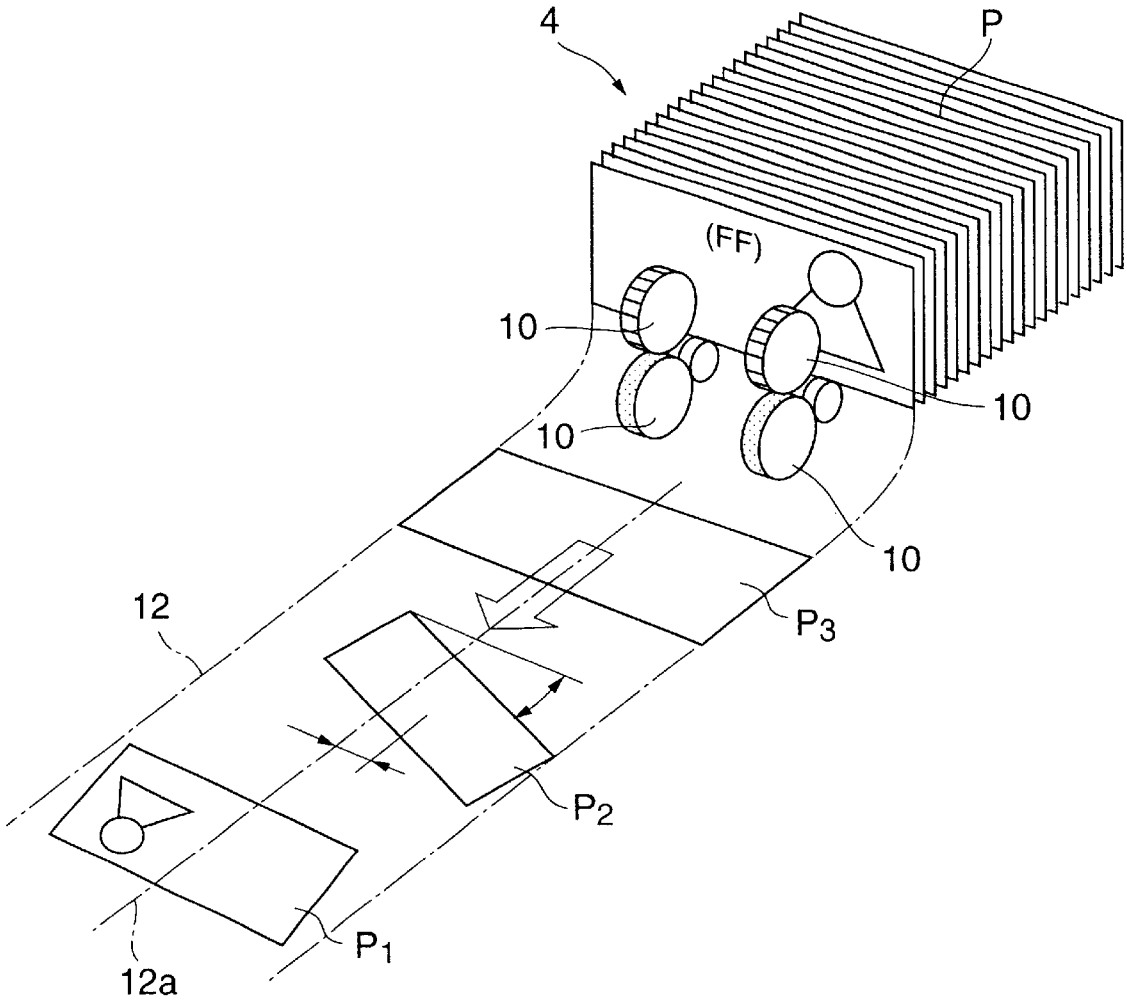
FIG. 2 is a perspective view showing the state to take out plural sheets of bank notes inserted into an insert port of the bank note processor shown in FIG. 1.

FIG. 2 is a perspective view showing plural sheets of the bank note P inserted into the insert portion 4 being taken out from the left end in order by one sheet at a time. As plural bank notes P in different sizes and kinds of money are inserted into the insert portion 4 in a lump, even when the bank notes are taken out after kept in contact the lower ends with the stage 4*a* as described above, they are not always conveyed in the normal conveying posture.

In the example shown in FIG. 2, a medium sized five thousand yen bank note P1 that was first taken out are scarcely shifted (hereinafter, referred to the shift) in the direction orthogonal to the central axis 12*a* of the conveying path 12 (hereinafter, referred to the cross direction). However, the right side corner was shifted in the right direction slightly preceding more than the left side corner (hereinafter, referred to the right skew) in the forward conveying direction. Further, a relatively small sized one thousand yen bank note P2 taken out secondly was shifted in the left direction along the conveying direction against the central axis 12*a*. Furthermore, the left side corner caused the angular shift in the left direction preceding the right side angular corner, that is, the left skew. Further, a relatively large sized ten thousand yen bank note P3 caused scarcely the shift and skew.

Thus, the bank notes P taken out of the insert portion 4 are not always conveyed in the normal conveying posture. In this embodiment; therefore, a posture correction device 20 (will be described later in detail) is provided at the downstream side of the conveying path in the conveying direction of the insert portion 4 in order to prevent defects originating in the improper conveying posture of bank notes P during the processing at the latter stage. This posture correction device 20 corrects the conveying posture of taken out bank notes P, that is, corrects skew and shift to the normal conveying posture.

The bank notes P taken out on the conveying path 12 by the take-out roller 10 are conveyed on the conveying path 12 extending nearly in the horizontal direction after passing the posture correction device 20 and their skew and shift are corrected properly by the posture correction device 20. In other words, all bank notes P passed through the posture correction device 20 are conveyed in the normal conveying posture with the centers positioned on the central axis 12*a* of the conveying path 12 and the longitudinal axes extended along the cross direction in parallel with it without shift and skew.

The conveying path 12 extended by passing through the posture correction device 20 is defined by conveying belts 14 and 16 that are stretched above and below the conveying path 12 so as to be able to endlessly run along the conveying direction. These conveying belts 14 and 16 are wound round plural rollers 15 provided in the cross direction (the bank note face direction). The conveying belts 14 and 16 are provided in 3 belts, respectively, which are separated in the cross direction and in contact with each other at the surfaces on the conveying path 12 (see FIG. 9).

At the end of the conveying path which is bent upward by the conveying belts 14 and 16, there is provided a detector 30 which detects features of bank note P such as kind of amount of money, front/back side, top/bottom, presence of dirt, break, etc. The detector 30 reads various information from the surface of bank note P being conveyed on the conveying path 12, logically calculates the read information, compares with information that become the reference and detects such features as described above.

In this embodiment, the posture correction device 20 is arranged in front of the detector 30 along the conveying direction of bank notes P and after stabilized the conveying posture of bank notes P to the normal posture, feeds them into the detector 30. Therefore, it becomes possible to set a detecting area of bank notes P by the detector 30 minimum and reduce a processing time needed for the logical calculation and the detecting process of bank notes P in the detector 30 can be executed at a high speed and high accuracy and reliability can be promoted.

By the way, bank notes P are inserted into the insert portion 4 with both sides and the top and bottom portions unsorted and when taken out on the conveying path 12, they are uneven in the direction, both sides, and top and bottom portions. Therefore, the bank notes P in plural kinds of money which pass through the detector 30 after the posture correction are versatile in the state of both front and back sides and top and bottom portions.

Figure 3:
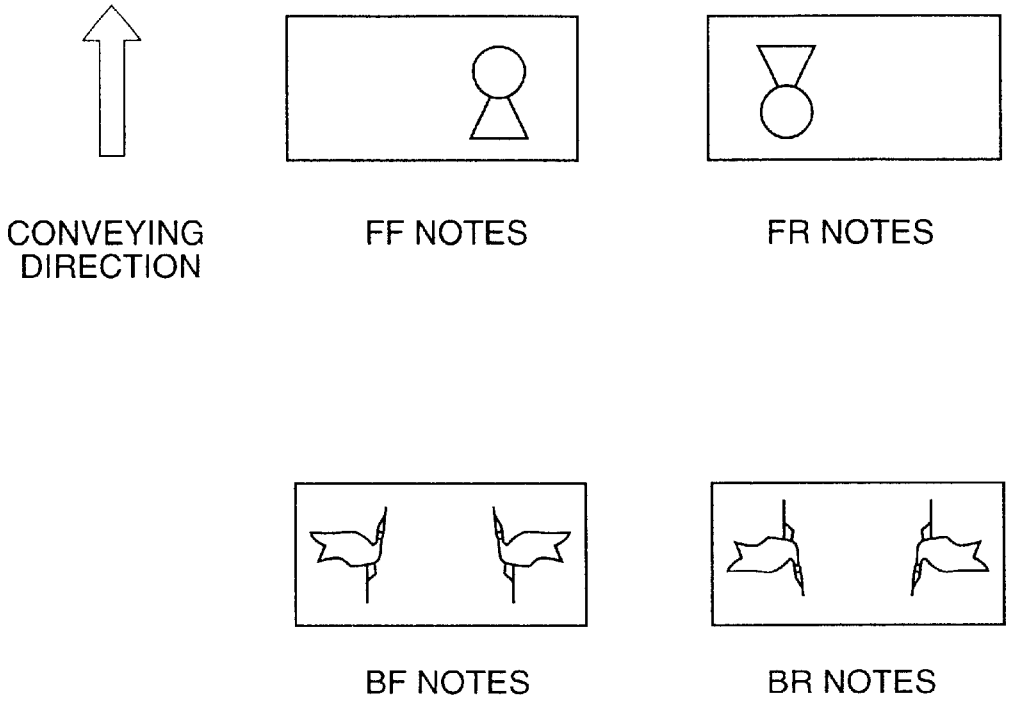
FIG. 3 is a schematic diagram for explaining the directions of both sides and the top and bottom of a bank note taken out of the insert port.

FIG. 3 shows 4 kinds of directions relative to the both sides and the top and bottom portions of the bank notes P passing through the posture correction device 20. In the explanation shown below, bank notes P taken out with the face turned up and the upper end directed forward in the conveying direction are called as FF notes, bank notes P taken out with the face turned up and the lower end directed forward in the conveying direction are called as FR notes, bank notes P taken out with the back side turned up and the upper end directed forward in the conveying direction are called as BF notes, and bank notes P taken out with the back side turned up and the lower end directed forward in the conveying direction are called as BR notes.

On the conveying path 13 extended to the downstream side of the detector 30, plural gates G1–G7 are provided for selectively changing the conveying direction of bank notes P based on the result of detection by the detector 30.

When it is judged that some bank notes cannot be processed at the later stage; for instance, bank notes taken out in two sheets at a time, those judged to have largely skewed above a prescribed level, damaged bank notes judged to be improper for re-circulation as proper notes, forged notes (not restricted to bank notes), etc. are conveyed in the right direction in FIG. 1 via a gate G1 and ejected into a rejection box 31. This rejection box 31 is accessible from the outside of the housing 2 of the sheet processing apparatus 1.

On the other hand, bank notes P that are judged to be normal bank notes and can be processed in the detector 30 are conveyed in the left direction in FIG. 1 toward a gate G2 via the gate G1. The bank notes P passed the gate G1 are in the state with both sides and the top and bottom portions unsorted. Such bank notes in the unsorted state of both surfaces and top and bottom sides are normally aligned by respective processing mechanisms, which are described later, at the downstream side of the gate G1, sorted by kind of money and stacked.

The conveying path at the downstream side of the Gate G2 is branched into two directions and the bank note P conveying direction can be selectively changed by changing the gate G2 between two positions.

On one of the conveying paths branched at the downstream side of the gate G2, a front/back side reversing mechanism 33 is provided for reversing the both sides of bank notes P like the mechanism disclosed in Japanese Laid-Open Patent Publication No. Hei 3-58984 (Laid open to public inspection on Sep. 9, 1991). The conveying path passing through this front/back side reversing mechanism 33 forms a twisted conveying path that is turned by 180° around the center axis toward the exit from the entrance. And along this twisted conveying path, two sets of conveying belts 32, 34 are provided for the face contact each other. Further, the other conveying path branched at the downstream side of the gate G2 becomes merely a conveying path 35 to allow bank notes P to pass.

Figure 4:
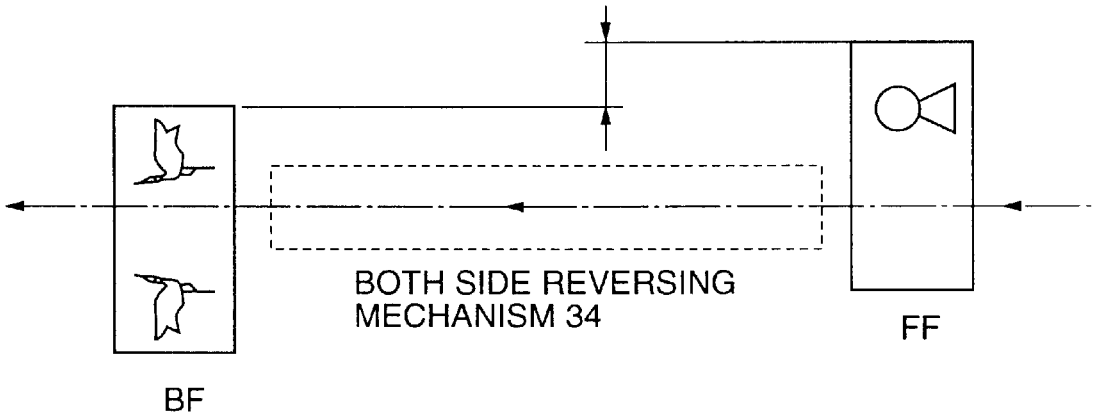
FIG. 4 is a rough sketch for explaining the reversing operation of both sides of a sheet by a both sides reversing mechanism incorporated in the bank note processor shown in FIG. 1.

Bank notes P that are divided by the gate G2 and conveyed through the twisted conveying path of the front/back side reversing mechanism 33 are reversed, for example, as shown in FIG. 4. FIG. 4 shows the state that bank notes (FF notes) conveyed into the both sides reversing mechanism 33 with the front side put on the top and the upper end at the head are reversed and carried out from the reversing mechanism 33 with the back side put on the top.

When the bank notes P conveyed while shifted in the right direction from the center axis 12*a* are reversed as shown in FIG. 4, the bank notes P carried out from the reversing mechanism 33 are shifted in the left direction. In other words, in order to carry out the bank notes P reversed in the reversing mechanism 33 in the normal posture, it becomes necessary to correct the posture of the bank notes P to the normal posture. In the bank note processing apparatus 1 in this embodiment, therefore, the posture correction device 20 is arranged on the conveying path 12 at the upper stream side of the front/back side reversing mechanism 33 to correct the skew and shift bank notes P and align the conveying posture. As a result, when binding bank notes P in a prescribed number of notes in a banding device, which will be described later, stacked bank notes can be tightly bound.

Both the bank notes P reversed when passing the front/back side reversing mechanism 33 and the bank notes P conveyed on the conveying path 35 are fed into a gate G3 through a joining portion 36. The length of the conveying path 35 is so set that a processing time of bank notes P to arrive at the joining portion 36 through the reversing mechanism 33 after passing the gate G2 and the conveying time of the bank notes P to arrive at the joining portion 36 after passing through the conveying path 35 becomes the same. As a result, the bank notes P conveyed through the front/back side reversing mechanism 33 and the bank notes P conveyed on the conveying path 35 pass through the joining portion 36 at the same timing and all the bank notes P can be processed under the same condition irrespective of the processing form.

The conveying path at the downstream side of the gate G3 is branched into two directions and bank notes P can be switched selectively by switching the gate G3 selectively between two positions.

On one of the conveying path branched at the downstream side of the gate G3, a top and bottom reversing mechanism 37 is provided for reversing the top and the bottom of bank notes P. The top and bottom reversing mechanism 37 has a switchback portion 38 to once hold bank notes P fed via the gate G3, a reversing roller 39 arranged adjacent to the switchback portion 38 to take out the bank notes P conveyed into the switchback portion 38 in the reverse direction from the rear end side, and a tapping wheel 40 to produce a conveying force to the bank notes P by pressing the rear ends of the bank notes P conveyed into the switchback portion 38 against the reversing roller 39.

The bank notes P fed into the top and bottom reversing mechanism 37 via the gate G3 are once held in the switchback portion 38 with the top end side along the conveying direction downward and the rear end side of the bank notes P along the conveying direction is pushed against the reversing roller 39 by the rotation of the tapping wheel 40. With the rotation of the reversing roller 39, the bank notes P held in the switchback portion 38 are taken out in the reverse direction with the rear end side at the head. As a result, the conveying direction of the bank notes P is reversed and the top and bottom are also reversed.

Further, the other conveying path branched at the downstream side of the gate G3 becomes merely the conveying path 41 to convey the bank notes P. Both the bank notes P passed through the top and bottom reversing mechanism 37 and the bank notes P conveyed by the conveying path 41 are conveyed toward a gate G4 via the joining portion 42. The length of the conveying path 41 is so set that a processing time of the bank notes P fed into the top and bottom reversing mechanism 37 via the gate G3 and a time of the bank notes P passing the conveying path 41 becomes the same.

The conveying path at the downstream side of the top and bottom reversing mechanism 37 forms a horizontal conveying path 43 extending in about the horizontal direction above plural stackers. Above this horizontal conveying path 43, four gates G4~G7 are provided.

At the branching position by the gate G4 at the most upper stream side, a banding device 44 to form a bundle of bank notes P by stacking, for example, 100 sheets of bank notes P with a paper strip. Bank notes P in the same kind of money value are conveyed into this banding device 44. The banding device 44 has a stacker 45 to selectively stack conveyed bank notes P via the gate G4, a banding portion 46 to band 100 sheets of the bank notes P stacked in the stacker 45 and a paper strip supply portion 47 to supply paper strips which are used for banding bank notes in the banding portion 46.

The bank notes P conveyed into the banding device 44 via the gate G4 are banded with paper strips supplied from the paper strip supply portion 47. A bundle of bank notes P banded in the prescribed number of sheets is carried out to the outside of the apparatus by a conveyor that is not illustrated.

At the branching positions by three gates G5, G6 and G7 provided at the downstream side of the gate G4 along the horizontal conveying path 43, there are provided four stackers 48, 49, 50 and 51 which are more than the number of gates by one. The bank notes P selectively sorted by the gate G5 are stacked in the stacker 48, the bank notes P selectively sorted by the gate G6 are stacked in the stacker 49, the bank notes P selectively sorted by the gate G7 are stacked in the stacker 50 or 51.

The bank notes P stacked in the stacker 45 of the banding device 44 and four stackers 48~51 are passed selectively through the both side reversing mechanism 33 and/or the top and bottom reversing mechanism 37 and stacked in the prescribed stackers in the state wherein the both sides and the top and bottom directions are aligned to a fixed direction.

Here, the operation to stack bank notes taken out of the insert portion 4 shown in FIG. 3 to the same direction by aligning four kinds of directions of the bank notes P will be explained referring to FIG. 5~FIG. 8.

Figure 5:
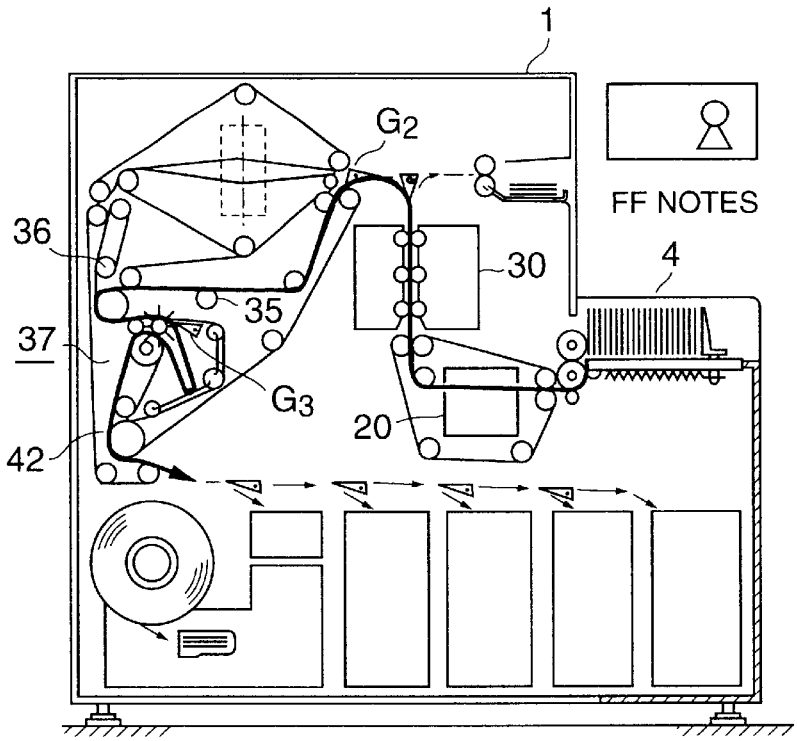
FIG. 5 is a rough sketch showing a FF bank note processing route in the bank note processor shown in FIG. 1.
Figure 6:
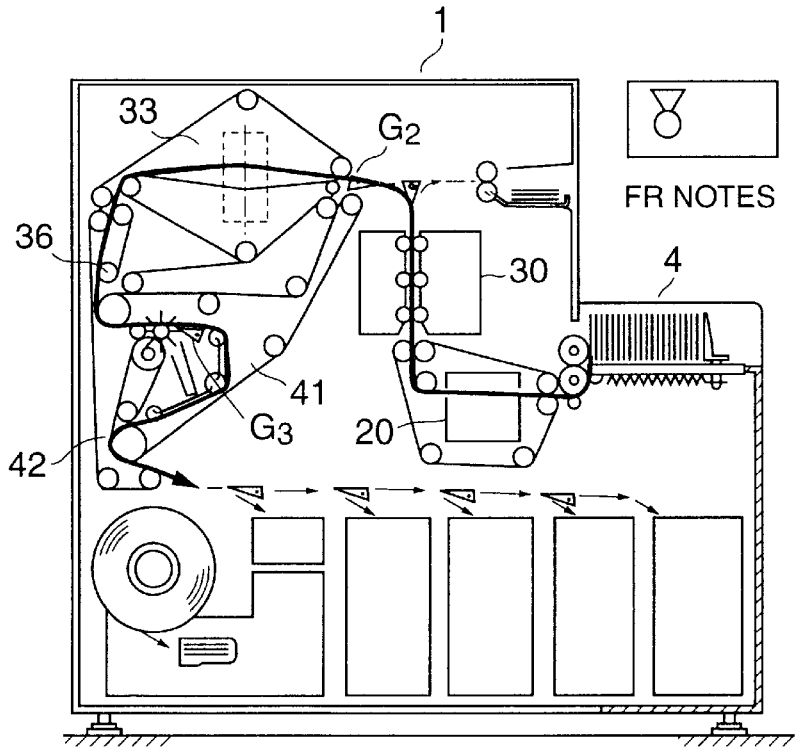
FIG. 6 is a rough sketch showing a FR bank note processing route in the bank note processor shown in FIG. 1.
Figure 7:
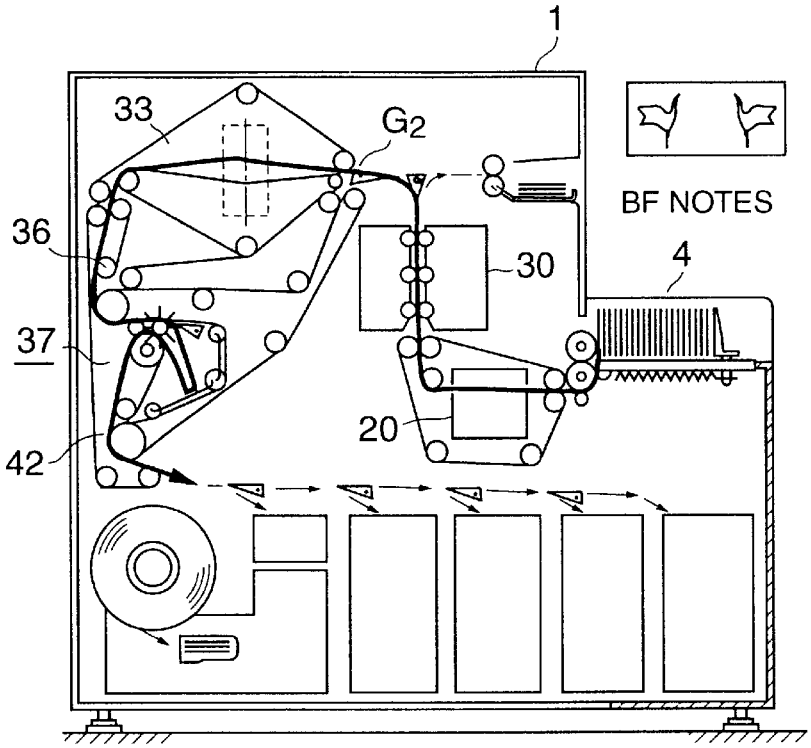
FIG. 7 is a rough sketch showing a BF bank note processing route in the bank note processor shown in FIG. 1.
Figure 8:
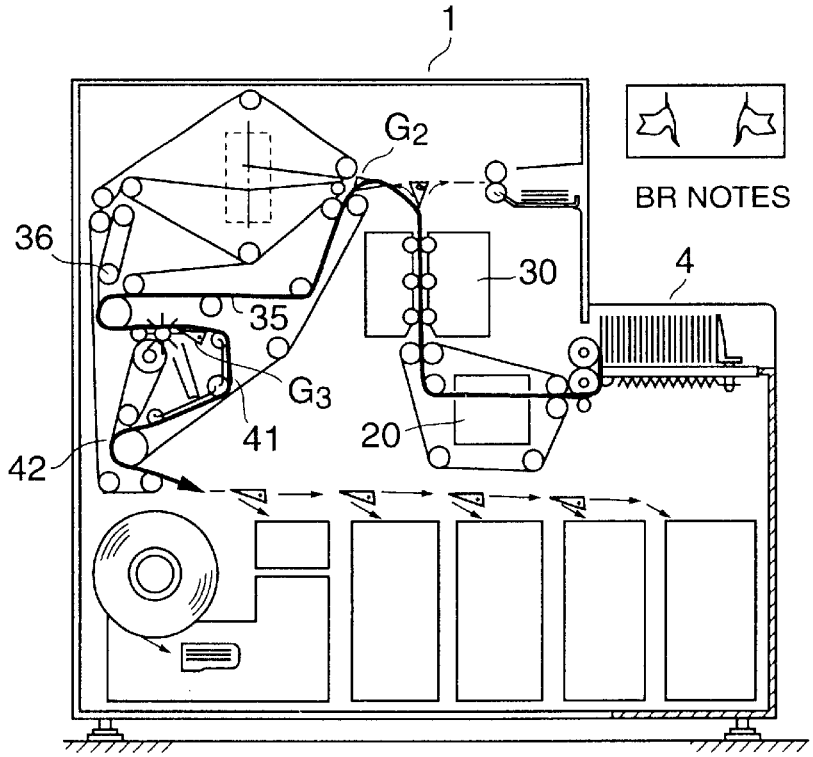
FIG. 8 is a rough sketch showing a BR bank note processing route in the bank note processor shown in FIG. 1.

FIG. 5 shows the processing route of the FF bank notes taken out with the front side turned upward and the upper end put the top. FIG. 6 shows the processing route of the FR bank notes taken out with the back turned upward and the top end put the top. FIG. 7 shows the processing route of the BF bank notes taken out with the back turned upward and the top end put the top. FIG. 8 shows the processing route of the BR bank notes taken out with the back turned upward and the lower end put the top.

As shown in FIG. 5, when the bank notes P taken out on the conveying path 12 from the insert portion 4 are detected to be the FF bank notes through the detector 30, these FF bank notes pass through the conveying path 35 via the gate G2. The FF bank notes passed through the conveying path 35 are led to the top and bottom reversing mechanism 37 via the joining portion 36 and the gate G3 and the top and the bottom are reversed and sent out. The FF bank notes sent out from the top and bottom reversing mechanism 37, after passing the joining portion 42, are sorted and stacked in the prescribed stackers 45, 48~51 by selectively switching the gates G4~G7 based on the result of the detection in the detector 30.

As shown in FIG. 6, when the bank notes P taken out on the conveying path 12 from the insert portion 4 are detected to be FR bank notes via the detector 30, these FR bank notes pass through the both side reversing mechanism 33 via the gate G2 and the both sides are reversed and the FR bank notes are sent out. The FR bank notes sent out from the both side reversing mechanism 33 pass the conveying path 41 via the joining portion 36 and the gate G3. The FR bank notes passed the conveying path 41 are sorted and stacked in the prescribed stackers 45, 48~51 by selectively switching the gates G4~G7 based on the result of detection in the detector 30.

As shown in FIG. 7, when the bank notes P taken out on the conveying path 12 from the insert portion 4 are detected to be BF bank notes through the detector 30, these BF notes pass through the both side reversing mechanism 33 via the gate G2 and sent out therefrom after the both sides are reversed. The BF notes sent out from the both side reversing mechanism 33 are led to the top and bottom reversing mechanism 37 via the joining portion 36 and the gate G3 and sent out therefrom after the top and bottom are reversed. The BF notes sent out from the top and bottom reversing mechanism 37 pass through the joining portion 42 and sorted and stacked in prescribed stackers 45, 48~51 as the gales G4~G7 are selectively switched based on the result of detection by the detector 30.

As shown in FIG. 8, when the bank notes P taken out on the conveying path 12 from the insert portion 4 are detected to be BR bank notes by the detector 30, these BF notes pass through the conveying path 35 via the gate G2. The BF notes passed to the conveying path 35 then pass the conveying path 41 via the joining portion 36 and the gate G3. The BF notes, passing through the conveying path 41 and passing the joining portion 42 are sorted and stacked in respective stacker 45, 48~51 by selectively switching the gates G4~G7 based on the result of the detection by the detector 30.

As described above, according to the bank note processor 1, bank notes P which are loose in the directions relative to the both sides and the top and bottom can be aligned automatically, sorted and stacked in desired stackers by automatically aligning all bank notes P in the same direction.

Figure 9:
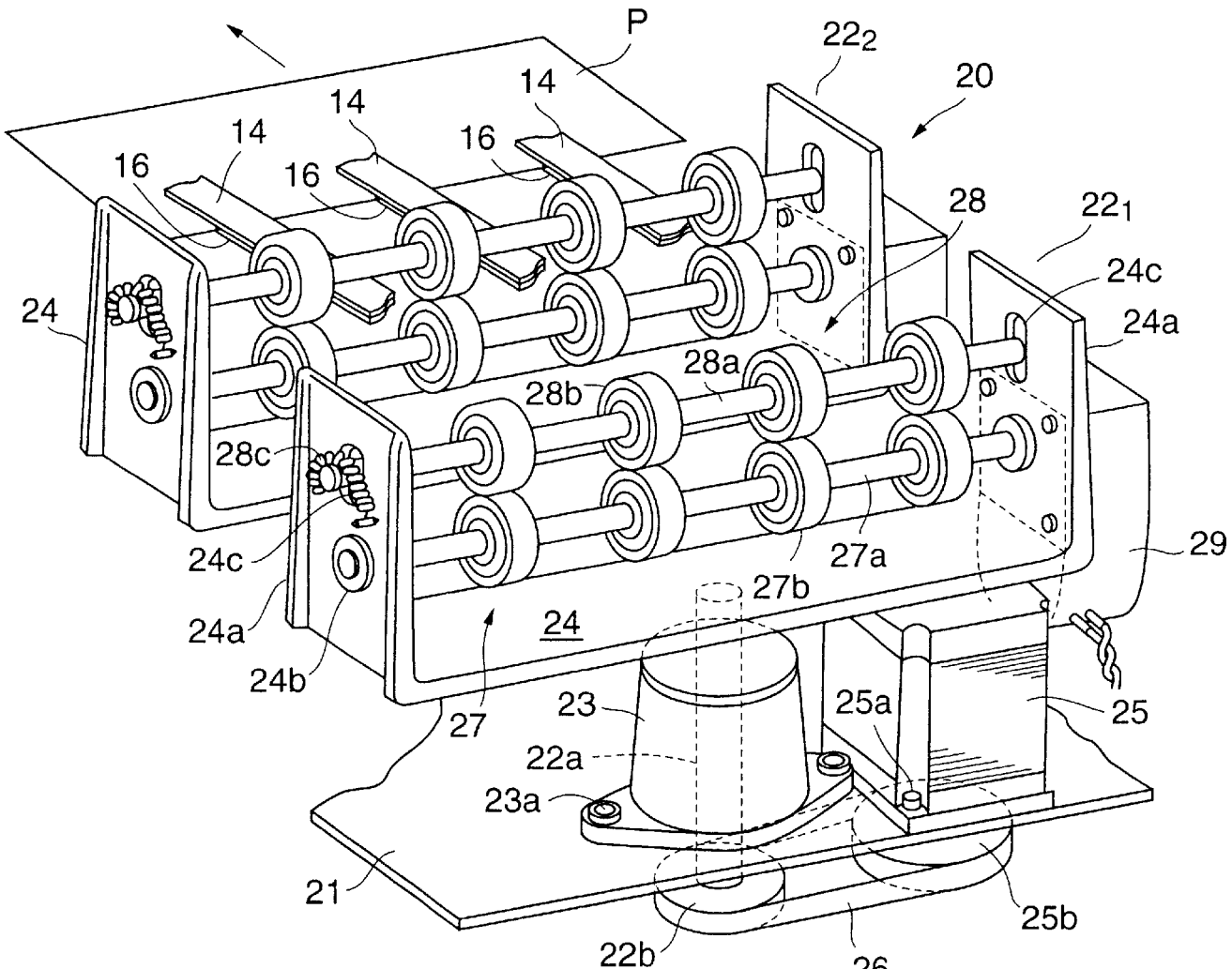
FIG. 9 is a perspective view showing a rough structure of a bank note posture correction device incorporated in the bank note processor shown in FIG. 1.

Next, the bank note posture correction device 20 will be described in detail referring to FIG. 9. FIG. 9 is a perspective view showing the outline of structure of the posture correction device 20. Here, a sheet of bank note P that is conveyed on the conveying path 12 extending in the horizontal direction through the posture correction device 20 is illustrated and 2 sets of 3 conveying belts 14 and 16 stretched to clamp and contact this note from the upper and lower sides are partially shown. The conveying belts 14 and 16 run along the conveying path 12 at a fixed velocity in the state separated each other in the cross direction.

The posture correction device 20 is mounted to a base member 21 which is stationary fixed to the housing 2 of the bank note processor 1. The posture correction device 20 has two correction mechanisms 221 and 222 in almost the same structure installed side by side on the base membrane 21 along the conveying direction of bank notes P. These correction mechanisms 221 and 222 are installed rotatably to the base membrane 21 centering round the rotary shaft 22*a* extending in the vertical direction. These two rotary shafts 22*a* are extending in the vertical direction along the axis penetrating the center axis (see FIG. 2) of the conveying path 12 extending by passing through the bank note processor 1 at the separated position along respective conveying directions. Since two correction mechanisms 221 and 222 are almost in the same structure, the correction mechanism 221 arranged at the upper stream side along the conveying direction of the bank note P will be explained and the explanation of the other correction mechanism 222 will be omitted here.

The rotary shaft 22*a* of the correction mechanism 221 is supported rotatably by a bearing 23 nearly in the cylindrical shape fixed to the base member 21 by screws 23*a*. On the upper end of the rotary shaft 22*a* thus extended in the vertical direction, frames 24 holding a correction roller pair rotatably, which is described later, are fixed. The frame 24 is extending along the cross direction orthogonal to the conveying direction of bank notes P and has a length in excess of the overall length of a largest size bank note P that is conveyed via the conveying path 12. Both ends of the frame 24 along the cross section are raised and bent to nearly a right angle.

At the lower end of the rotary shaft 22*a* extending through the bearing 23, a pulley 22*b* with a belt 26 is mounted. A belt 26 is put over this pulley 22*b* and a pulley 25*b* mounted to the rotary shaft of a motor 25 fixed to the base member 21 with a screw 25*a*. When the motor 25 is driven, its driving force is transmitted to the frame 24 by way of the pulley 25*b*, the belt 25, the pulley 22*b* and the rotary shaft 22*a*, and the frame 24 is turned around the rotary shaft 22*a*. Further, the rotating position of the frame 24 can be optionally set by the control of the motor 25.

On two side walls 24*a* erected upward from both ends in the cross direction of the frame 24, bearings 24*b* are formed to rotatably support both ends of the rotary shafts 27*a* of the correction roller 27 which are extended in the cross direction underside of the conveying path 12. Further, a rotary shaft (not shown) of a motor 29 mounted to the outside of the side wall 24*a* of the rear side end of the rotary shaft 27*a* of the correction roller 27 is directly connected the rear side end of the rotary shaft 27*a*.

Further, on two side walls 14*a* of the frame 24, two bearing grooves 24*c* are formed respectively to holding the conveying path 12 between. These bearing grooves 24*c* support a rotary shaft 28*a* of a correction roller 28 that rotates while in contact with the correction roller 27 so as to be able to slide upward and downward. At the outside of the bearing groove 24*c* of each side wall 24*a*, a spring 28*c* is mounted to force the end of the rotary shaft 28*a* of the correction roller 28 downward along the bearing groove 24*c*.

The correction roller pair 27 and 28 arranged at the positions to clamp the conveying path 12 have plural (4 pieces here) rubber rollers 27*b* and 28*b* which are rotated while in contact with each other. These rubber rollers 27*b* and 28*b* are arranged staggering each other so as not interfer 3 sets of conveyor belts 14 and 16 extending along the conveying path 12. Further, the compression force of the spring 28 to press the upper correction roller 28 against the lower correction roller 27 is so set that the force of the correction roller pair 27 and 28 to clamp a bank note P becomes stronger than the restricting force of the conveyor belts 14 and 16.

When the motor 29 runs, the lower correction roller 27 is rotated and the upper correction roller 28 press fitted to this correction roller 27 is simultaneously rotated. As a prescribed clamping force has been given between the correction roller pair 27 and 28 by the spring 28*c* at this time, a bank note P that is led between both correction rollers via the conveying path 12 is clamped by the correction roller pair 27 and 28 preferentially to the restriction by the conveyor belts 14 and 16.

Next, referring to FIG. 10, the operation to correct the conveying posture of a bank note P taken out on the conveying path 12 by the posture correction device 20 will be explained.

Figure 10:
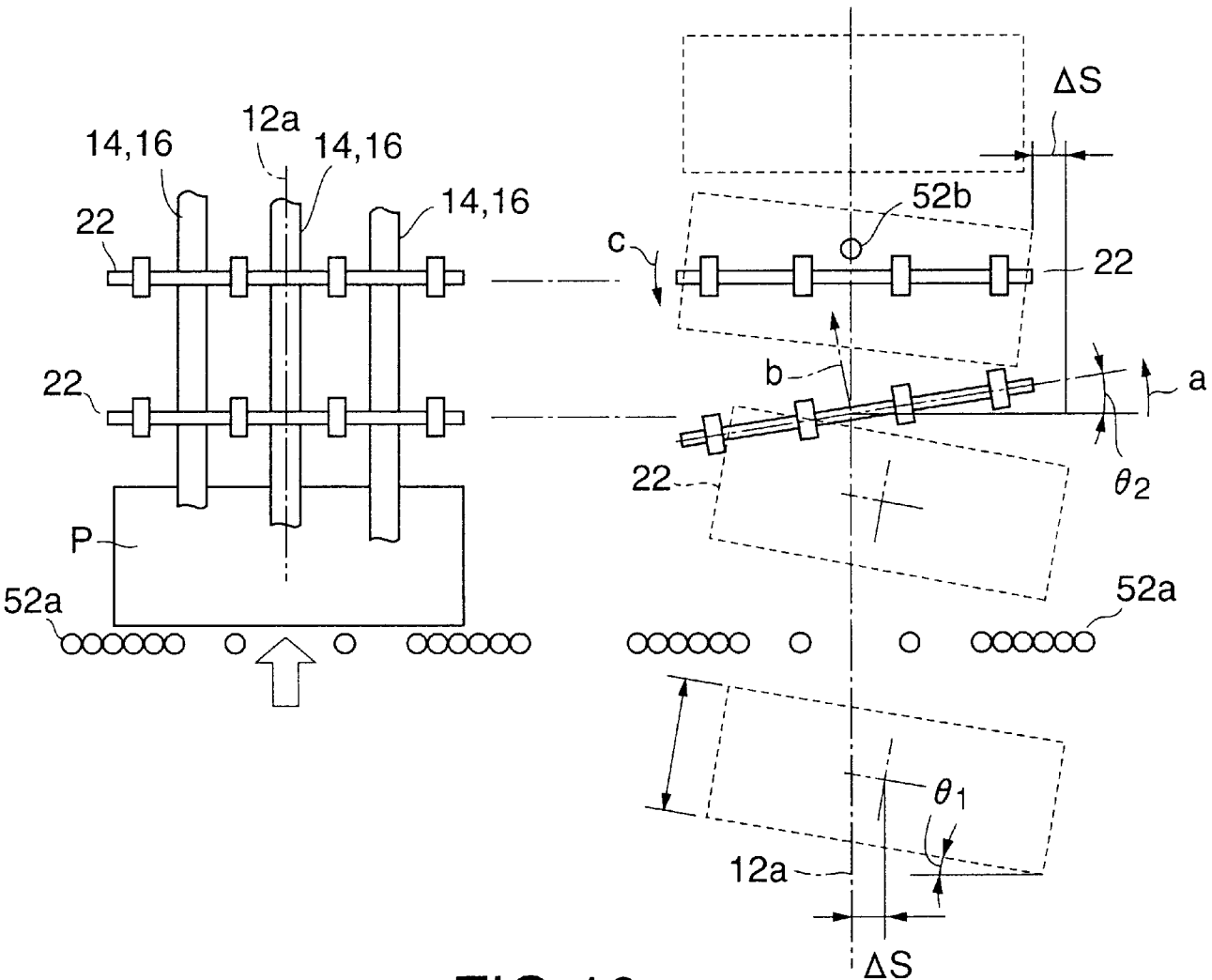
FIG. 10 is a diagram for explaining the operation to correct the bank note conveying posture by the bank note posture correction device shown in FIG. 9.

In FIG. 10, at its left side the state to send a bank note P in the proper conveying posture without skew and shift through the posture correction device 20 is illustrated. Further, in the right side, the state wherein the conveying posture of a bank note P that has a shift in the right direction to the center axis 12*a* of the conveying path 12, that is, the right shift and a left skew of the left side corner preceding. Further, on the conveying path 12 at this side of the posture correction device 20, a transmitted light sensor array 70 extending along the cross direction is provided and the conveying posture (shift and skew) of a bank note P is detected via this light sensor array 70.

That is, a bank note P taken out on the conveying path 12 from the insert portion 4 of the bank note processor 1 passes through the light sensor array 70 provided at this side of the posture correction device 20 and a shift amount Δ and a skew angle θ1 are detected. Then, θ2 satisfying the following formula is calculated:

$$\tan \theta 2 = \Delta S / L$$

where, L is a width in the short direction along the conveying direction of a bank note P.

Then, the correction mechanism $22_1$ at the upper stream side in the conveying direction is rotated in the direction of arrow a by the calculated angle θ2 and the rotary shafts 27*a* and 28*a* of the correction roller pair 27 and 28 of the correction mechanism $\mathbf{22}_1$ are tilted by the angle θ2. This rotating operation of the correction mechanism $\mathbf{22}_1$ at the upper stream side should be made before a bank note P is conveyed to the correction mechanism $\mathbf{22}_1$. As a result, the conveying direction of the bank note P by the upper stream side correction mechanism $\mathbf{22}_1$ is set in the direction of arrow b.

When a bank note P passed the upper stream side correction mechanism $\mathbf{22}_1$ under this state, the bank note P is shifted to the left side by ΔS along the cross direction when it reaches the downstream side correction mechanism $\mathbf{22}_2$ and the right shift at the time when inserted is thus corrected.

Further, at the timing when the leading edge of a bank note P is sensed by a sensor 72 arranged near the downstream side correction mechanism $\mathbf{22}_2$, that is, under the state where the bank note P is clamped between the correction roller pair of the downstream side correction mechanism $\mathbf{22}_2$, the downstream side correction mechanism $\mathbf{22}_2$ is rotated by the angle θ1 in the direction of arrow c and the skew of the bank note P is corrected.

As described above, the shift and skew of a bank note P can be corrected safely and certainly by the continuous correcting operation by two correction mechanisms $\mathbf{22}_1$ and $\mathbf{22}_2$ arranged side by side along the conveying direction of the bank note P. Therefore, it becomes possible to feed a bank note P passed through the posture correction device 20 wherein its conveying posture is corrected into the detector 30 and its detection accuracy can be promoted.

Further, because the conveying posture of all bank notes P can be kept in the normal conveying posture stably, it is possible to prevent generation of shift of the bank notes P in the cross direction when both sides are reversed in the both side reversing mechanism 34. In addition, it is also possible to prevent generation of the jam of bank notes in the switchback portion when the top and bottom of the bank notes are reversed in the top and bottom reversing mechanism 40.

Further, this invention is not restricted to the above-mentioned embodiment but can be deformed variously within the scope of this invention. For example, in the above embodiment, the posture correcting mechanism 20 equipped with two correction mechanisms $\mathbf{22}_1$ and $\mathbf{22}_2$ along the conveying direction of bank note P was used; however, when the shift and skew of bank notes P are relatively less, the shift and skew can be corrected simultaneously with one correction mechanism. In this case, for example, in order to correct the shift before conveying a bank note P, the correction mechanism should be kept rotating in advance and the bank note P is conveyed to correct its shift and immediately thereafter, the correction mechanism is rotated to correct the skew in the state wherein the bank note is clamped between the correction roller pair 27 and 28.

Further, in the above-mentioned embodiment, the conveying posture of a bank note P is corrected in the posture correction device 20 based on the center axis 12*a* of the conveying path 12. However, not restricted to this but the conveying posture of a bank note P may be corrected by striking its one end against the reference plane along one end of the conveying path 12.

Further, in the above embodiment, following the first correction mechanism $\mathbf{22}_1$ which corrects the shift along the direction crossing the conveying direction of a bank note P, the second correction mechanism $\mathbf{22}_2$ is provided to correct the angular shift of a bank note P in the posture correction device 20; however, the first and second correction mechanisms $\mathbf{22}_1$ and $\mathbf{22}_2$ may be arranged in the reverse order along the conveying mechanism.

Next, a second embodiment of the present invention will be explained in detail referring to FIGS. 11~20.

Further, in the first embodiment of the present invention, the top and bottom reversing mechanism 37 is provided at the downstream side of the both side reversing mechanism 33 but the second embodiment differs in that the both side reversing mechanism 33 is provided at the upper stream side of the top and bottom reversing mechanism 37. Further, in the first embodiment the banding device 44 is provided and four stackers 48–51 are provided. In the second embodiment, a banding device is not provided but six stackers 68–73 are provided. Accordingly, in the second embodiment, the same component elements as those in the first embodiment are assigned with the same reference numerals and the explanations are omitted.

Figure 11:
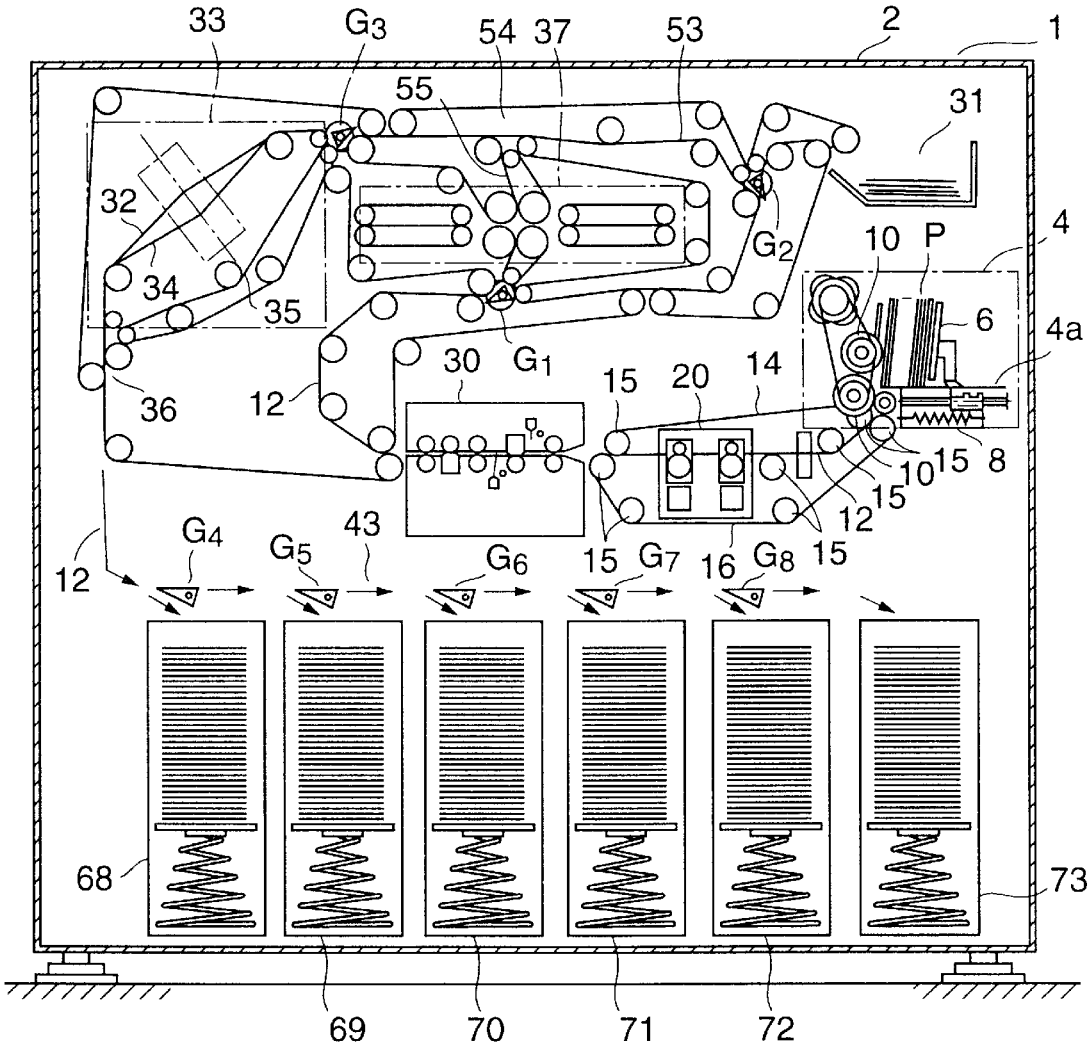
FIG. 11 is a schematic diagram showing the internal structure of a bank note processor as a second embodiment of the sheet processing apparatus of the present invention.

As shown in FIG. 11, on the conveying path 12 which is extended from the downstream of the detector 30 passing through the bank note processor 1, plural gates G1–G8 are provided for selectively changing the conveying direction of a bank note P based on the result of detection by the detector 30.

At the most upper stream position on the conveying path 12 extending from the detector 30, that is, at the position most close to the detector, the gate G1 is arranged. The conveying path 12 is branched into two directions by the gate G1 and the conveying direction of a bank note P is selectively changed by changing the gate G1 selectively between two positions.

On one conveying path branched nearly vertically upward by the gate G1, the top and bottom reversing mechanism 37 (a switchback mechanism) is provided for reversing the top and bottom of a bank note P. The top and bottom reversing mechanism 40 functions to reverse the top and bottom of a bank note P fed into the upper portion of FIG. 11 via the gate G1 by reversing the conveying direction of the bank note P and feed it again on the conveying path 12. The detailed structure and action of the top and bottom reversing mechanism 37 will be described later in detail. Further, when reversing the top and bottom of a bank note P, it is needed to once stop the conveying of it and send out in the reverse direction and therefore, a processing time of a bank note P by the top and bottom reversing mechanism 37 becomes relatively long.

Therefore, in order to earn a processing time by the top and bottom reversing mechanism 37, the other conveying path branched by the gate G1; that is, a bypass conveying path 53 to bypass the top and bottom reversing mechanism 37 is extended relatively long. In other words, it is required to extend the bypass conveying path 53 relatively long so that bank notes P passed the bypass conveying path 53 will reach a joining portion 54 at the dame time interval and the processing order is not exchanged.

In this embodiment, using the bypass conveying path 53 which required to be extended long, bank notes that cannot be processed in the bank note processor 1 and to be excluded are removed. That is, bank notes that are judged to be taken in double sheets, largely skewed exceeding a prescribed level, damaged or false bank notes (not necessarily bank notes) in the detector 30 become bank notes to be excluded. These bank notes are ejected into a rejection box 31 when the gate G2 provided in the middle to the bypass conveying path 53 is selectively switched. The rejection box 31 is arranged above the inert portion 4 and can be accessed from the outside of the housing 2.

In other words, as the bypass conveying path 53 is extended to near the rejection box 31, the gate G2 is provided, the conveying path for rejecting bank notes to be excluded is also used as the bypass conveying path 53 for bypassing the top and bottom reversing mechanism 37, it becomes possible to reduce the number of parts such as roller, belt, gate, etc., simplify the system construction and reduce a system manufacturing cost.

On the conveying path 12 at the downstream side of the joining portion 54 of the top and bottom reversing mechanism 37 and the bypass conveying path 53, the gate G3 is arranged for selectively changing the conveying path in two directions.

On one of the conveying paths branched by the gate G3, the both side reversing mechanism 33 is provided for reversing both sides of a bank note P. This both side reversing mechanism 33 is in the same structure as that described in the first embodiment and therefore, the explanation thereof will be omitted.

The conveying path 12 at the downstream side of the both side reversing mechanism 33 forms a horizontal conveying path 43 extending in about the horizontal direction above plural stackers. Above the horizontal conveying path 43, five gates G4–G8 are provided at about equal distances.

At the branching positions by five gates G4, G5, G6, G7 and G8, there are provided six stackers 68, 69, 70, 71, 72 and 73, which are more than the number of gates by one. Bank notes P branched from the horizontal conveying path 43 by the gate G4 at the most upper stream side are stacked in the stacker 68, bank notes P branched by the second gate G5 are stacked in the stacker 69, bank notes P branched by the third gate G6 are stacked in the stacker 70, bank notes P branched by the fourth gate G7 are stacked in the stacker 71, and bank notes P branched by the gate G8 at the most downstream side are stacked in the stacker 72 or 73.

Bank notes P are passed selectively through the top and bottom reversing mechanism 37 and/or the both side reversing mechanism 33 and their both sides and the top and bottom are aligned in a fixed direction and stacked in the prescribed stackers, respectively.

Next, the operations of the bank note processor 1 in the above-mentioned structure will be explained. Here, the operation to align bank notes P taken out of the insert portion 4 in anyone of four kinds of directions (see FIG. 3) and stack in the same direction will be explained referring to FIG. 12 through FIG. 15.

Figure 12:
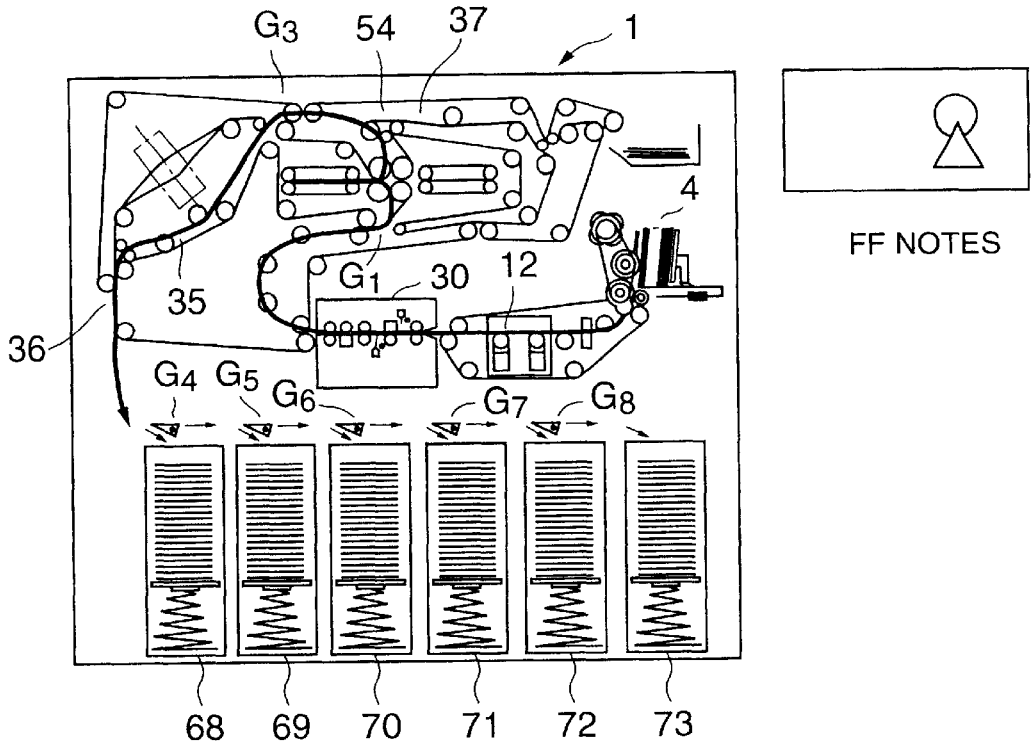
FIG. 12 is a schematic diagram showing the FF bank note processing route in the bank note processor shown in FIG. 11.
Figure 13:
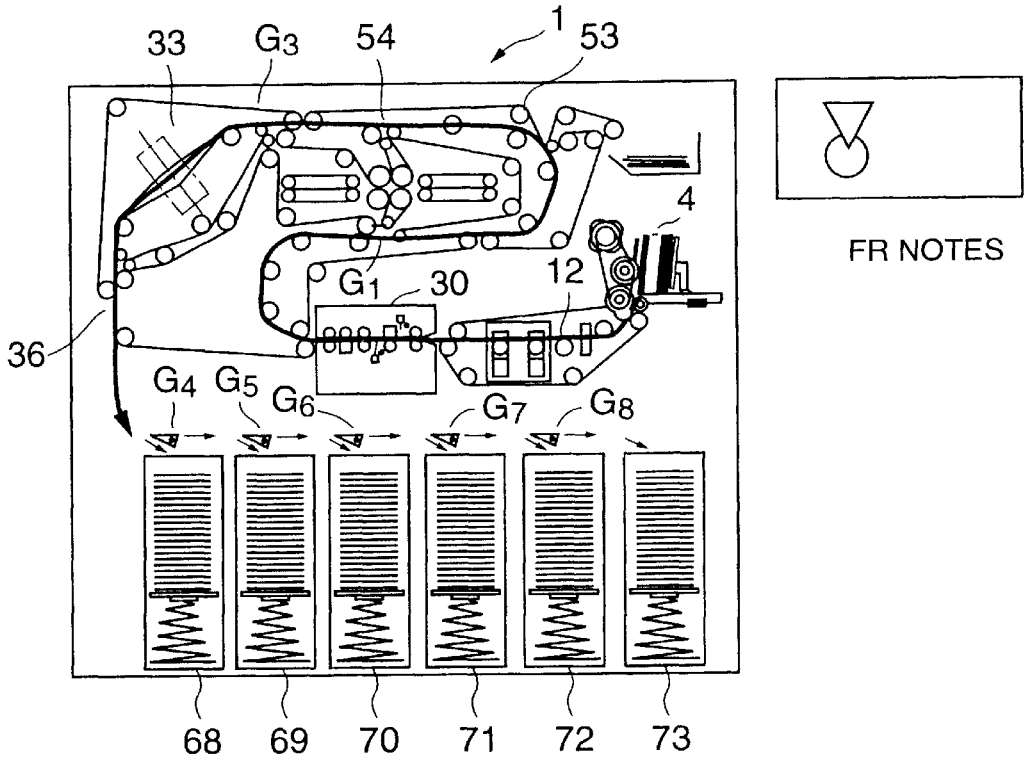
FIG. 13 is a schematic diagram showing he FR bank note processing route in the bank note processor shown in FIG. 11.
Figure 14:
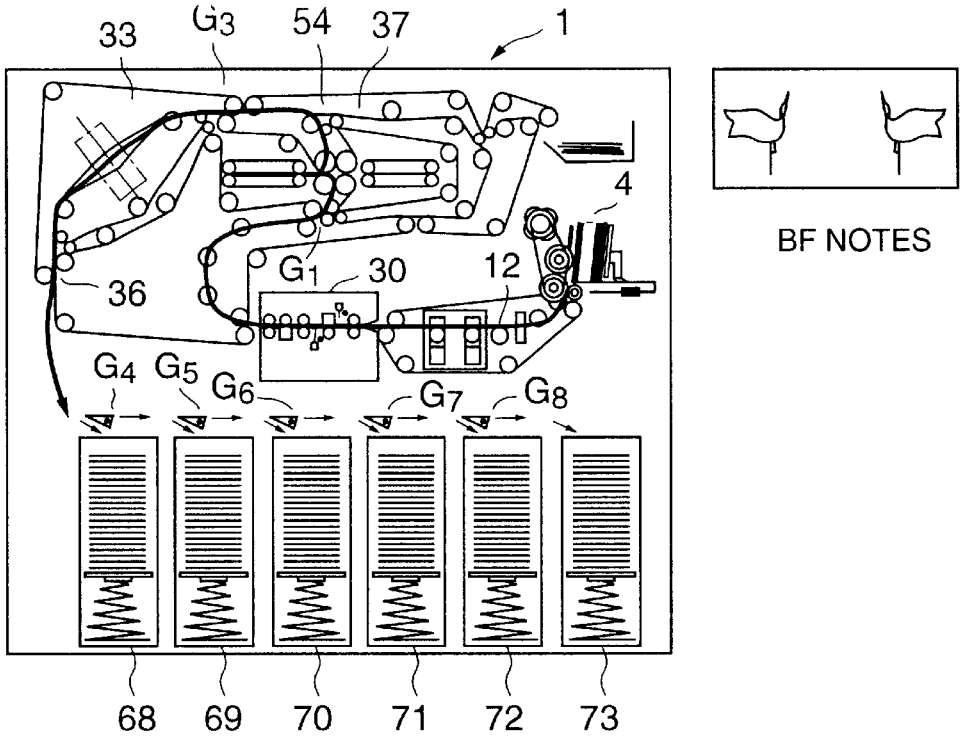
FIG. 14 is a schematic diagram showing the BF bank note processing route in the bank note processor shown in FIG. 11.
Figure 15:
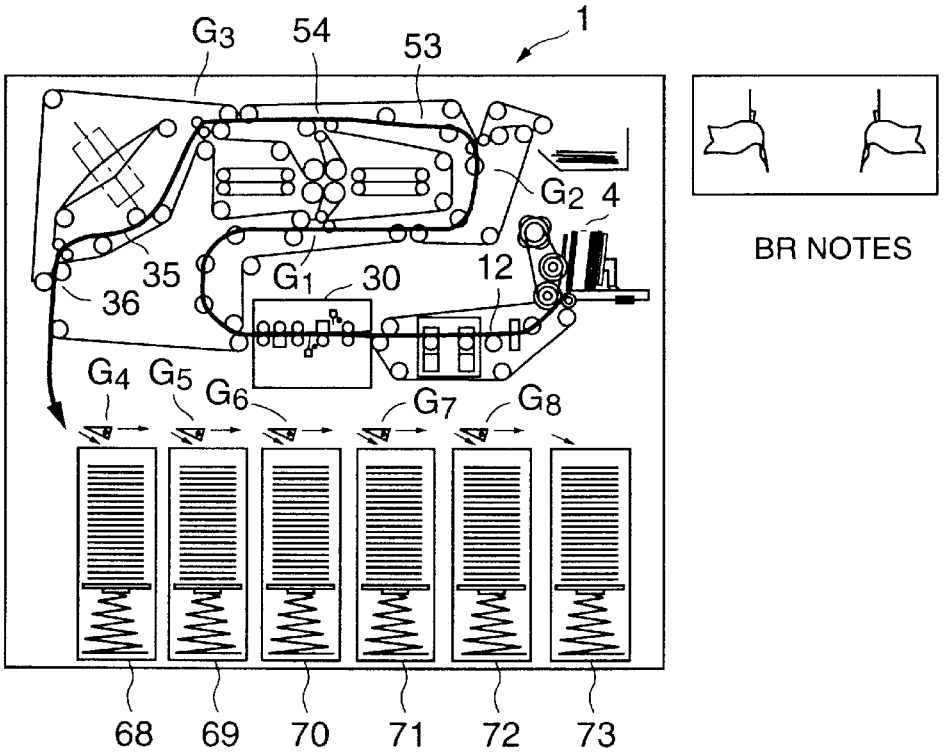
FIG. 15 is a schematic diagram showing the BR bank note processing route in the bank note processor shown in FIG. 11.

FIG. 12 shows the processing route of FF notes taken out with the front surface up and the upper end at the top. FIG. 13 shows the processing route of the FR notes taken out with the front surface up and the lower end at the top. FIG. 14 shows the processing route of BF notes taken out with the back up and the upper end at the top. FIG. 15 shows the BR notes taken out with the back up and the lower end at the top.

As shown in FIG. 12, when bank notes P taken out on the conveying path 12 from the insert portion 4 are detected to be FF notes, they are fed into the top and bottom reversing mechanism 37 via the gate G1. The FF notes sent out after the top and bottom were reversed in the top and bottom reversing mechanism 37 are passed on the conveying path 35 via the joining portion 54 and the gate G3. After passing the joining portion 36, the FF notes passed on the conveying path 35 are classified and stacked in the prescribed stackers 68–73 by selectively changing the gates G4–G8 based on the result of detection by the detector 30.

As shown in FIG. 13, when bank notes P taken out on the conveying path 12 from the insert portion 4 are detected to be FR notes by the detector 30, these FR notes pass hrough the bypass conveying path 53 via the gates G1 and G2 and sent into the both side reversing mechanism 33 via the joining portion 54 and the gate G3. The FR notes fed into the both side reversing mechanism 33 pass the twisted conveying path, wherein the both sides are reversed and pass the joining portion 36. After passing the joining portion 36, the FR notes are classified and stacked in the prescribed stackers 68–73 as the gates G4–G8 are selectively changed based on the result of detection by the detector 30.

As shown in FIG. 14, when bank notes P taken out on the conveying path 12 from the insert portion 4 are detected to be BF notes by the detector 30, the BF notes are fed into the top and bottom reversing mechanism 37 via the gate G1. The BF notes of which top and bottom are reversed in the top and bottom reversing mechanism 37 are led to the both side reversing mechanism 33 via the joining portion 54 and the gate G3, wherein their both sides are reversed and sent out. The BF notes sent out from the both side reversing mechanism 33 pass through the joining portion 36, and classified and stacked in the prescribed stackers 68–73 as the gates G4–G8 are selectively changed based on the result of detection by the detector 30.

As shown in FIG. 15, when bank notes P taken out on the conveying path 12 from the insert portion 4 are detected as BR notes by the detector 30, the BR notes pass the bypass conveying path 53 via the gates G1 and G2. After passing the bypass conveying path 53, the BR notes pass the conveying path 35 via the joining portion 54 and the gate G3. The BR notes passed the conveying path 35 pass the joining portion 36 and then, are classified and stacked in the prescribed stackers 68–73 as the gates G4–G8 are selectively changed based on the result of detection by the detector 30.

By the way, when a bank note P taken out on the conveying path 12 from the insert portion 4 is detected as a bank note to be excluded by the detector 30, this bank note is ejected into the rejection box 31 via the gate G2 after led to the bypass conveying path 53 via the gate G1. FR notes not requiring the top and bottom reversing and BR notes are led to the bypass conveying path 53 via the gate G1 together with these bank notes to be excluded.

As described above, according to the bank note processor 1 in this embodiment, it is possible to automatically align the uneven directions relative to the both sides and the top and bottom uniform and classify all bank notes P in the same direction automatically and stack in desirable stackers.

Further, according to the bank note processor 1 of this embodiment, the bypass conveying path 53 which required to be extended relatively longer is bypassed near the rejection box 31 and the gate G2 is provided on the bypass conveying path 53 to communicate to the rejection box 31, and utilizing this bypass conveying path 53, bank notes to be excluded are ejected into the rejection box 31. Therefore, it becomes possible to remove bank notes to be excluded using the bypass conveying path 53 which is for bypassing the top and bottom reversing mechanism 37, reduce the number of parts such as rollers, belts and gates comprising the conveying path, simplify the system construction and reduce a system manufacturing cost.

Next, the above-mentioned top and bottom reversing mechanism 37 which functions as a switchback mechanism of the present invention will be explained in detail referring to FIG. 16 and FIG. 17.

The top and bottom reversing mechanism 37 is arranged at the downstream side of the detector 30 and has a conveying path 55 which is extending almost in the vertical direction from the gate G1 to the joining portion 54 passing through the top and bottom reversing mechanism 37. Further, the top and bottom reversing mechanism 37 has a pair of frames 56 which are erected almost in the vertical direction and separated each other at the front and rear sides of the bank note processor 1 so as to clamp the conveying path 55 from the front and the rear. The pair of frames 56 are arranged by separating at least a more broader space than the most wide bank notes P that are conveyed on the conveying path 55 and fixed to the housing 1 of the bank note processor 1. In FIG. 16, the front side frame is omitted to simplify the illustration. Plural component members comprising the top and bottom reversing mechanism 37 are attached to the pair of frames 56.

Between the pair of frames 56, four conveying rollers 58*a*, 58*b*, 58*c* and 58*d* each of which has a rotary shaft extending from the front side to the rear side of the processor are installed in the state wherein they are arranged closely each other at the upper, lower, left and right sides. In FIG. 16, two conveying rollers 58*a* and 58*b* at the upper side are omitted to simplify the illustration. The conveying rollers have three cylindrical rollers 59 which are split along the axial direction in order to wind three conveying belts at the positions which are separated equally spaces in the axial direction.

Figure 17:
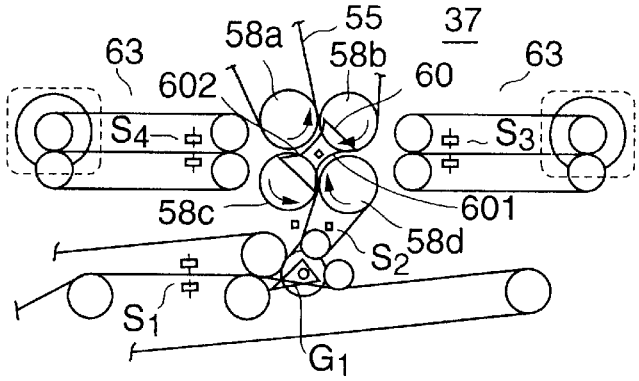
FIG. 17 is a front view of the switchback mechanism shown in FIG. 16 viewed from the front side of the bank note processor.

Two conveying rollers 58*a* and 58*b* are provided vertically at the left side to the conveying path 55 slightly separated each other in FIG. 17 and other two conveying rollers 58*b* and 58*d* are provided vertically at the right side to the conveying path 55 slightly separated each. Two conveying rollers 58*a* and 58*b* provided at the downstream side, that is, at the upper side along the conveying path 55 are provided opposite at the positions to clamp the conveying path 55 so that the surfaces of the conveying belts wound round the rollers 59 contact each other along the conveying path 55. Two conveying rollers 58*c* and 58*d* provided at the upper streams side along the conveying path 55, that is, at the lower side are provided so that the surfaces of the conveying belts wound round the respective rollers 59 contact each other on the conveying path 55. The conveying rollers 58*a*, 58*b*, 58*c* and 58*d* themselves may be driven or the driving force is transmitted to them via the conveying belts wound round the rollers 59 and they are rotated at a constant speed in the directions shown by an arrow in FIG. 17.

Among four conveying rollers 58*a*, 58*b*, 58*c* and 58*d*, there is a guide member 60 for guiding bank notes conveyed via the conveying path 55 to two switch back portions 63, which will be described later, and returning bank notes accepted in the switchback portions 63 on the conveying path 55.

The guide member 60 has a rotary shaft 60*a* that is extending almost in parallel with the rotary shafts of the conveying rollers 58*a*, 58*b*, 58*c* and 58*d*. Both ends of the rotary shaft 60*a* are rotatably supported by bearings attached to the pair of frames 56. The rear side end of the guide portion 60 is extended by penetrating the bearing provided to the rear side frame 56 and connected to a rotary solenoid 61 mounted to the rear side frame 56 via a supporting frame 57*a*.

Further, the guide member 60 has four gate blocks 60*b* which are arranged alternately against the rollers 59 of four conveying rollers. All of the four gate blocks 60*b* are formed in the same shape and mounted at equal spaces and in the same posture along the rotary shaft 60*a*. The guide member 60 is able to rotate (move) between the rotating position where the gate blocks 60*b* becomes the posture shown in FIG. 18A and the posture shown in FIG. 18B when the rotary solenoid 61 is driven.

Figure 18A:
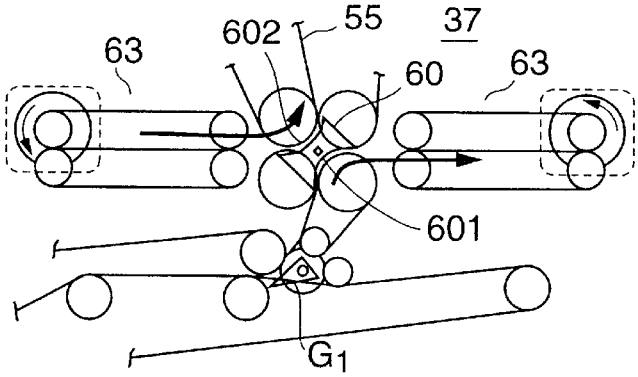
FIGS. 18A to 18C are diagrams for explaining the bank note switchback operation by the switchback mechanism shown in FIG. 17.
Figure 18B:
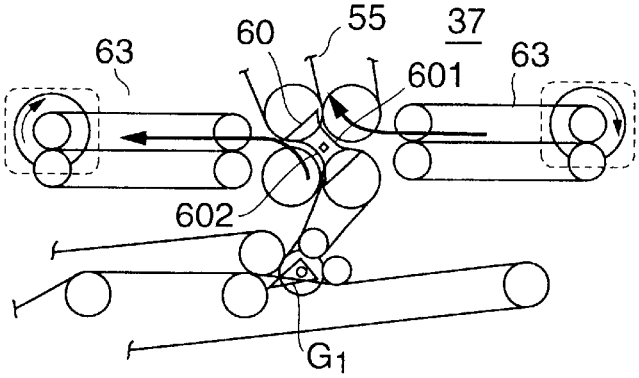

Each of the gate blocks 60*b* has a curved guide surface 601 which functions to guide a bank note fed through the conveying path 55 to a right side switchback portion 63 when it is rotated to the posture (the first position) shown in FIG. 18A and returns a bank note accepted in the right side switchback portion 63 on the conveying path 55 when rotated to the posture (the second position) shown in FIG. 18B, and has a curved guide surface 602 which functions to guide a bank note fed through the conveying path 55 to a left side switchback portion 63 when it is rotated to the posture shown in FIG. 18B and return a bank note accepted in the left side switchback portion 63 through the conveying path 55 when rotated to the posture (the second position) shown in FIG. 18A, respectively.

Further, an example wherein the gate block 60*b* is rotated from the first position to the second position by 90° in the counterclockwise direction in the above; however, on the contrary, the gate block may be rotated by 90° in the clockwise direction.

Figure 18C:
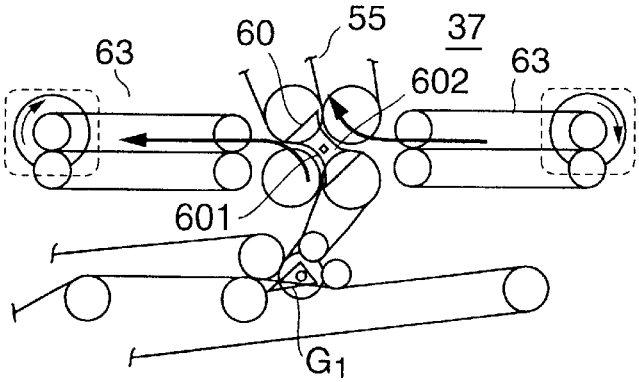

In other words, each of the gate blocks 60*b* has a curved guide surface 601 which functions to guide a bank note fed through the conveying path 55 to the right side switchback portion 63 when it is rotated to the posture (the first position) shown in FIG. 18A and guide a bank note fed through the conveying path 55 to the left side switchback portion 63 when rotated by 90° in the clockwise direction, and a curved guide surface 602 which functions to return a bank note accepted in the left side switchback portion 63 on the conveying path 55 when rotated to the posture (the first position) shown in FIG. 18A and return a bank note accepted in the right side switchback portion 63 on the conveying path 55 when rotated to the posture (the second position) shown in FIG. 18C by 90° in the clockwise direction, respectively.

At the right side and the left side of four conveying rollers 58*a*, 58*b*, 58*c* and 58*d* in the figure, the switchback portion 63 is provided to reverse the top and bottom, that is, the conveying direction of bank notes. To the switchback portion 63 at the right side of the figure, bank notes that are led to the conveying path 55 via the gate G1 are guided by passing between the conveying rollers 58*b* and 58*d* via the guide surface 601 in the state with the guide member 60 rotated to the position shown in FIG. 18A, and to the switchback portion 63 at the left side in the figure, bank notes that are led to the conveying path 55 via the gate G1 are guided by passing between the conveying rollers 58*a* and 58*c* via the guide surface 602 in the state with the guide member 60 rotated to the position shown in FIG. 18B. The left and right switchback portions 63 are formed in symmetrical shapes and almost in the same structure and therefore, the switchback portion 63 at the right side in the figure will be explained here.

The switchback portion 63 functions so as to receive bank notes guided almost in the horizontal direction via the guide surface 601, once stop them by decelerating in the restricted state by clamping the bank notes from the upper and lower sides, accelerate them in the reverse direction and return them on the conveying path 55 again via the guide membrane 60.

Figure 16:
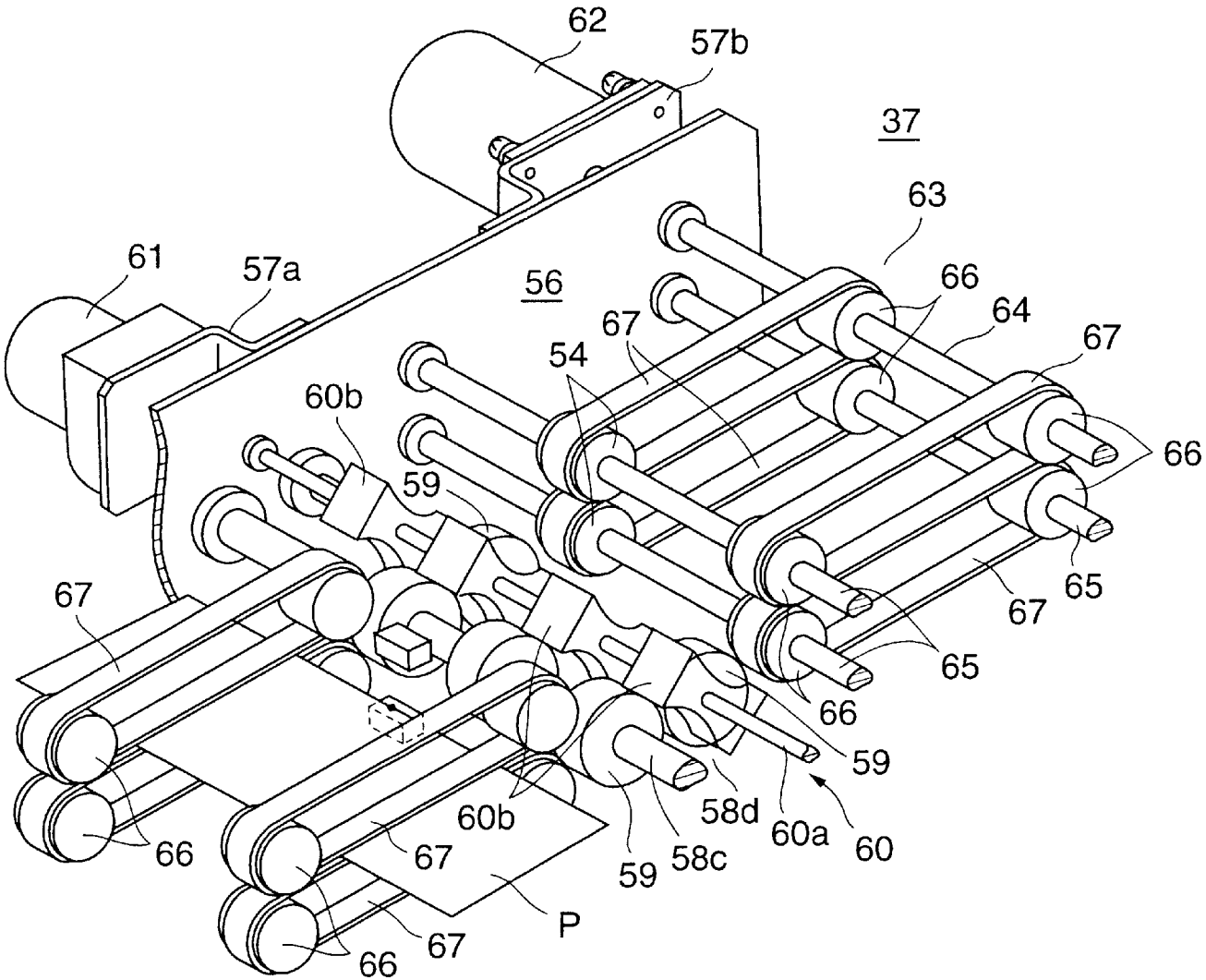
FIG. 16 is a perspective view showing the rough structure of a switchback mechanism of the present invention incorporated in the bank note processor shown in FIG. 11.

The switchback portion 63 has one driving roller 64 and three driven rollers 65 as shown in FIG. 16. The rollers 64 and 65 have rotary shafts extending from the front side to the rear side of the processor and both sides of each rotary shaft are rotatably supported by the frame pair 56 by way of bearings. The rear side end of the driving roller 64 is extending by penetrating through the rear side frame 56 and connected to a rotary shaft of a motor 62 that is mounted to the frame 56. The motor 62 is capable of rotating in the forward and reverse directions and the running speed also can be controlled precisely.

The rollers 64 and 65 have two cylindrical rollers 66, which are separated in the axial direction, respectively. An endless belt 67 is stretched over these rollers 66. Above the horizontal surface to where bank notes are guided via the guide surface 601, the driving roller 64 and one driven roller 65 are arranged and separated each other. Two belts 67 are stretched over these rollers. Under the horizontal surface, two rollers 65 are arranged and two belts 67 are stretched over them. Two sets of two belts 67 are contacted at the surfaces via the horizontal surface and bank notes guided onto the horizontal surface can be conveyed in the restrained state by clamping them between the belts 67.

Further, the top and bottom reversing mechanism 37 has the four sensors S1, S2, S3 and S4 to get the operating timings of the gate G1, the rotary solenoid 61 and the motor 62. These sensors are of transmission type equipped with a photodiode and an LED, and sense the passage of a bank note as the optical axis is cut when a bank note passes. The sensor S1 is provided at the upper stream side of the gate G1 and senses the arrival of bank notes. The sensor S2 is provided on the conveying path 43 between the gate G1 and the guide member 60. The sensors S3 and S4 are provided near the entrance in the left and right switchback portions 63, respectively and get the operating timing of the motor 62 of each switchback portion 63.

The top and bottom reversing mechanism 37 constructed as described above is operated as shown below.

When a bank note is led to the top and bottom reversing mechanism 37 via the gate G1, the guide member 60 is rotated to, for example, the position shown in FIG. 18A. The fed bank note is guided to the right side switchback portion 63 via the guide surface 601. At this time, when a bank note P is accepted in the left side switchback portion 63, this bank note P is returned on the conveying path 55 via the guide surface 602 of the guide member 60. That is, in the state wherein the guide member 60 is rotated to one position, a sheet of bank note is guided to the right side switchback portion 63 and at the same time, another sheet of bank note can be sent out of the left side switchback portion 63.

Hereafter, when a next bank note is fed via the gate G1, the guide member 60 is rotated to the position shown in FIG. 18B. Thus, the second sheet of bank note is guided to the left side switchback portion 63 via the guide surface 602. At the same time, the first sheet of bank note accepted in the right side switchback portion 63 is returned on the conveying path 55 via the guide surface 601. When the above operation is repeated, the top and bottom of plural bank notes are reversed. Further, when the conveying gap of bank notes that are continuously fed changed, it can be coped with by adjusting a stopping time of bank notes accepted in the left and right switchback portions 63.

Figure 19:
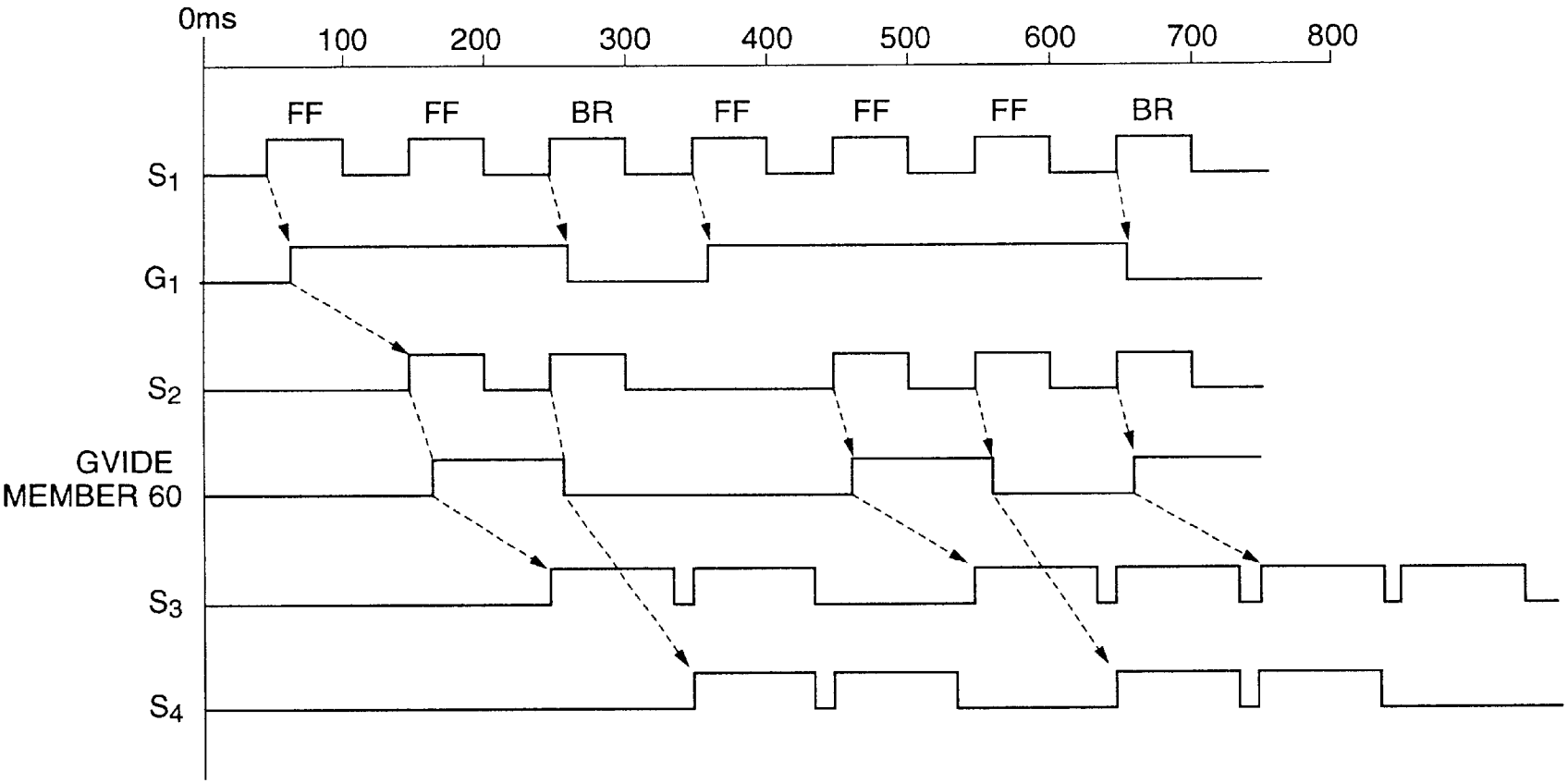
FIG. 19 is a timing chart for explaining the timing of the operation by the switchback mechanism.

Next, the example of operation by the top and bottom reversing mechanism 37 in the structure described above will be explained referring to a timing chart shown in FIG. 19. Here, the processing operation when 7 sheets of bank notes pass through the gate G1 continuously in the order of FF note, FF note, BR note, FF note, FF note, FF note and BR note will be explained. Needless to say, the FF notes pass through the top and bottom reversing mechanism 37 via the gate G1 and the BR notes pass the bypassing conveying path 53 via the gate G1.

That is, when a note is detected to be an FF note by the detector 30, the gate G1 is switched toward the top and bottom reversing mechanism 37 when the leading edge of that FF note arrives at the sensor S1. When FF notes are fed in succession, the gate G1 is kept at the position as it is. When a BR note is fed, the gale G1 is switched to the position connecting to the bypassing conveying path 53 and when an FF note is fed again, the gate G1 is switched to the position connecting to the top and bottom reversing mechanism 37. In other words, the first, second, fourth, fifth and sixth sheets of FF notes only are fed into the top and bottom reversing mechanism 37 in this embodiment.

When the leading edge of an FF note arrive at the sensor S2, the guide member 60 is turned to the position shown in FIG. 18A and the FF note is guided to the right side switchback portion 63 via the guide surface 601. When the leading edge of the FF note arrives at the sensor S3 of the right side switchback portion 63, the motor 62 is rapidly decelerated so as to decelerate that FF note and when the trailing edge of the FF note passes the sensor S3, the speed of the FF note is reduced to zero, that is, it is stopped.

Thus, when the FF note is being guided to the switchback portion 63 at the right side, succeeding FF notes are fed in succession and therefore, when the leading edge of next FF note arrives at the sensor S2, the guide member 60 is rotated to the position shown in FIG. 18B. As a result, a next FF note is guided to the left side switchback portion 63 via the guide surface 602. In this case, the motor 62 is also controlled to run at the timing obtained by the sensor S4 and the next FF note is rapidly decelerated and stopped.

At this time, when a next FF note is accepted in the left side switchback portion 63, the motor 62 of the right side switchback portion 63 is turned in the reverse direction at the same time, and the FF note accepted in the right side switchback portion 63 is accelerated in the reverse direction and returned to the conveying path 55 via the guide surface 601 (the state shown in FIG. 18B).

By repeating the above operation alternately at the left and right sides, the top and bottom of plural FF notes fed into the top and bottom reversing mechanism 37 continuously is reversed. Further, when bank notes are not fed in the switchback portion 63 successively so that the third sheet of BR note is conveyed between the second and fourth FF notes likewise this embodiment, the timing signal from the sensor S2 to rotate the guide member 60 is not obtained. In this case, when one sheet of bank note has been entered in the switchback portion 63 and the next bank note is going to return to the bypass conveying path side, the sensor S1 is retarded by a time equivalent to the conveying distance of the sensors S1 and S2 from the timing when the leading edge of a next bank note passed and the guide member is controlled to rotate.

As described above, according to the top and bottom reversing mechanism 37 of the present invention, the conveyance of a bank note is once stopped by decelerating its conveying speed in the restrained state by clamping the bank note accepted in the switchback portion 63 and then, the bank note is taken out and returned on the conveying path 55 by accelerating its speed in the reverse direction. Therefore, it is not required to stop the conveyance by striking the leading edge of a bank note against the stopper as in an existing switchback mechanism, such defects as the bending or damage of the leading edge of even a bank note of which stiffness is weak is not generated and bank notes can be switch backed surely and stably.

Further, according to the top and bottom reversing mechanism 37 of the present invention, plural sheets of bank notes that are successively fed from one entrance by the conveying path 55 are selectively sorted to two switchback portions 63 alternately and returned on the original conveying path 55 through one exit alternately. Therefore, when compared with an existing switchback mechanism, it is possible to make the conveying gap of bank notes successively fed extremely short and sharply improve efficiency of process.

Further, this invention is not restricted to the embodiments described above but can be modified within the scope of the invention. For example, in the above embodiments, a case using two switchback portions of such type that the conveying speed of bank notes is decelerated in the restrained state by clamping them is explained. But not restricting to this case, the two switchback portions of such type that a conveying speed is decelerated by striking the leading edge of a bank note against the stopper may be usable as before. Even in this case, when the guide member 46 of this invention is used, the bank note processing efficiency can be promoted.

Figure 20:
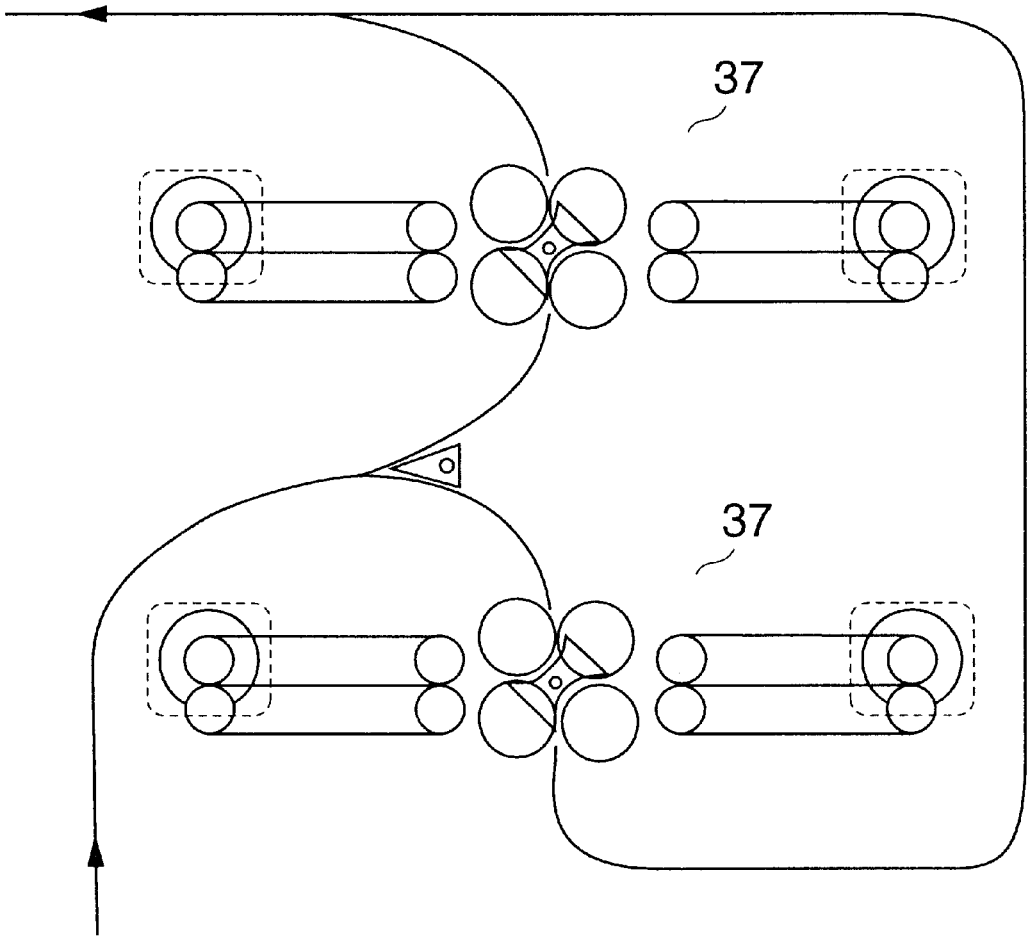
FIG. 20 is a schematic diagram showing a modified example of the switchback mechanism.

Further, in the above-mentioned embodiments, the selective sorting of bank notes fed from the conveying path 55 into two switchback portions 63 is explained, but more than three switchback portions 63 may be used. For example, as a first deformed example, two sets of the top and bottom reversing mechanisms 37 equipped with two switchback portions 63 may be connected as shown in FIG. 20.

Next, a bank note processor 100 in a third embodiment of the present invention is described in detail referring to FIG. 21 through FIG. 31.

Further, although the structure of the top and bottom reversing mechanism and its peripheral members of the bank note processor 100 differs from those of the bank note processor 1, other portions are the same and therefore, the structural elements which function similarly to the bank note processor 1 in the second embodiment are assigned with the same reference numerals and the detailed explanations are omitted.

Figure 21:
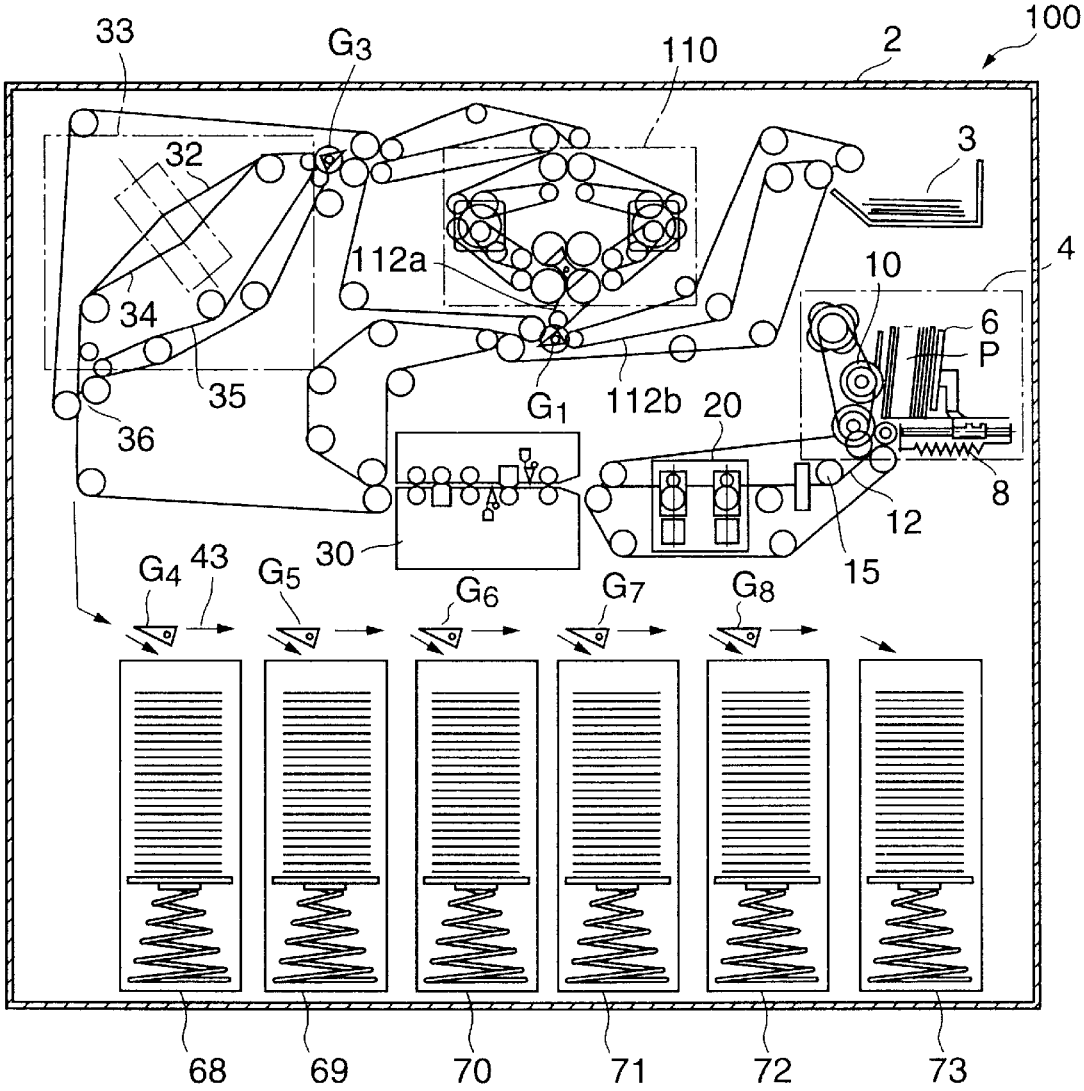
FIG. 21 is a schematic diagram showing the internal structure of a bank note processor which is a third embodiment of the sheet processing apparatus of the present invention.

As shown in FIG. 21, the bank not processor 100 (a paper-like material processing apparatus) has a top and bottom reversing mechanism 110 (a switchback mechanism) for selectively reversing the top and bottom of a bank not P passed through the detector 30 according to the result of detection. The top and bottom reversing mechanism 110 is provided on a conveying path 112*a* which is branched by the gate G1 provided at the downstream side of the detector 30. This top and bottom reversing mechanism 110 is capable of reversing the top and bottom of a bank note P that is fed through the conveying path 112*a* and sending out to the processing portion at the latter stage and also, capable of sending out a bank note that is fed trough the conveying path 112*a* directly without reversing its top and bottom. That is, the top and bottom reversing mechanism 110 once accepts all bank notes P except those that are to be excluded. Further, the detailed structure and actions of this top and bottom reversing mechanism 110 are described later in detail.

On the other hand, at the end of the other conveying path 112*b* that is branched by the gate G1, a rejection box 31 is provided for excluding bank notes that cannot be processed by the bank note processor and to be excluded.

Because the top and bottom reversing mechanism 110 of the third embodiment has the structure that is able to pass bank notes P directly without reversing the top and bottom as described above, a bypass conveying path 53 is not required for bypassing the top and bottom reversing mechanism 37 as in the second embodiment. Because of this, in this embodiment it is possible to reduce the bypass conveying path to lead bank notes P from the gate 1 on the conveying path 112*b* and from the gate G2 to the exit side of the top and bottom reversing mechanism 110 and the number of parts such as the conveyor belt, conveying roller, conveying guide, gate, etc. when compared with the second embodiment.

Next, the operation to stack bank notes P by aligning them in the same direction by the bank note processor 100 constructed as described above is explained referring to FIG. 22 through FIG. 25.

Figure 22:
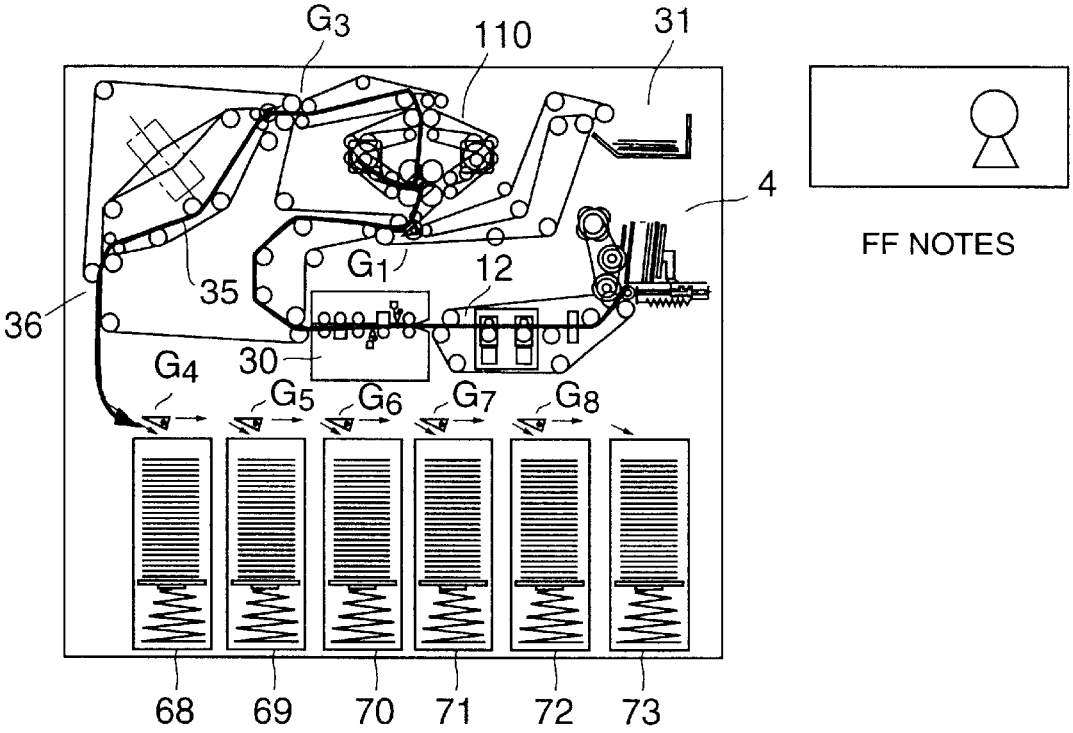
FIG. 22 is a schematic diagram showing an FF note processing route in the bank note processor shown in FIG. 21.

As shown in FIG. 22, bank notes P taken out on the conveying path 12 from the insert port 4 and detected to be FF notes in the detector 30 are conveyed into the top and bottom reversing mechanism 110 through the gate G1 and the top and bottom are reversed therein. The bank notes P sent out after reversing the top and bottom pass on the conveying path 35 through the gate G3. The bank notes P passed the conveying path 35 and then, passed the joining portion 36 and are sorted and stacked in the prescribed stackers 68–73 as the gates G4–G8 are selectively changed based on the result of detection in the detector 30.

Figure 23:
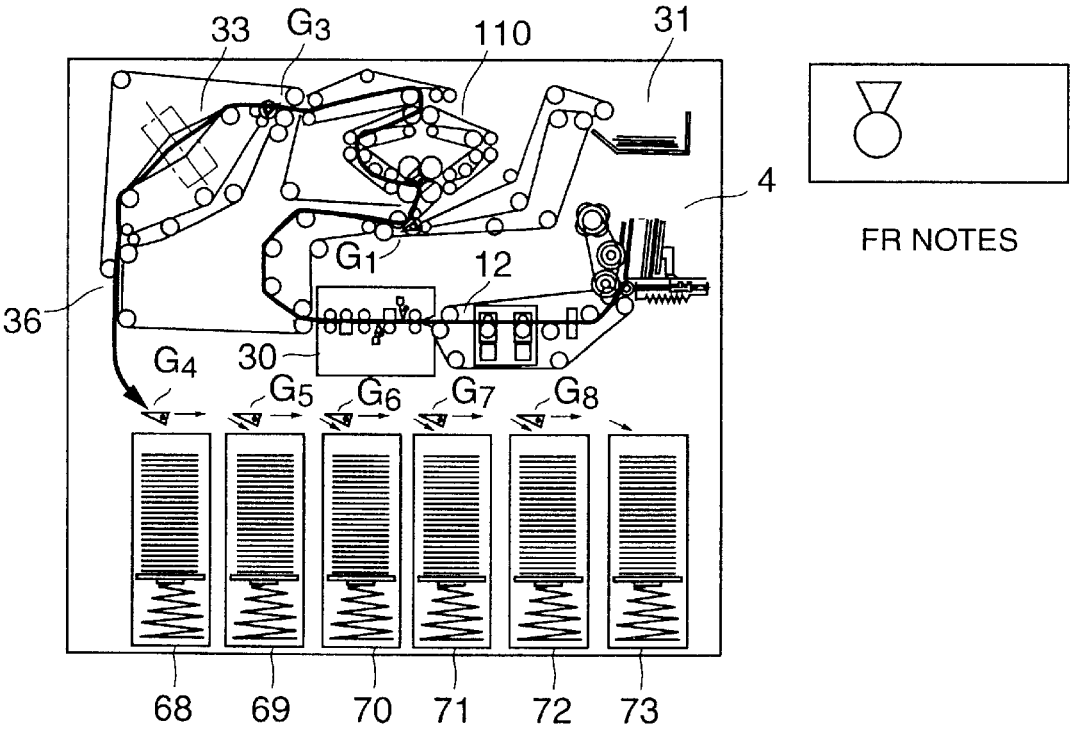
FIG. 23 is a schematic diagram showing an FR note processing route in the bank note processor shown in FIG. 21.

As shown in FIG. 23, bank notes P taken out on the conveying path 12 from the insert port 4 and detected to be FR notes by the detector 30 pass through the top and bottom reversing mechanism 33 and are sent into the front/back reversing mechanism 33 through the gate G3. The bank notes P sent into the front/back reversing mechanism 33 pass through the twisted conveying path, wherein both sides are reversed, and then, pass the joining portion 36. The bank notes passed the joining portion 36 are sorted and stacked in the prescribed stackers 68–73 as the gates G4–G8 are selectively changed based on the result of detection in the detector 30.

Figure 24:
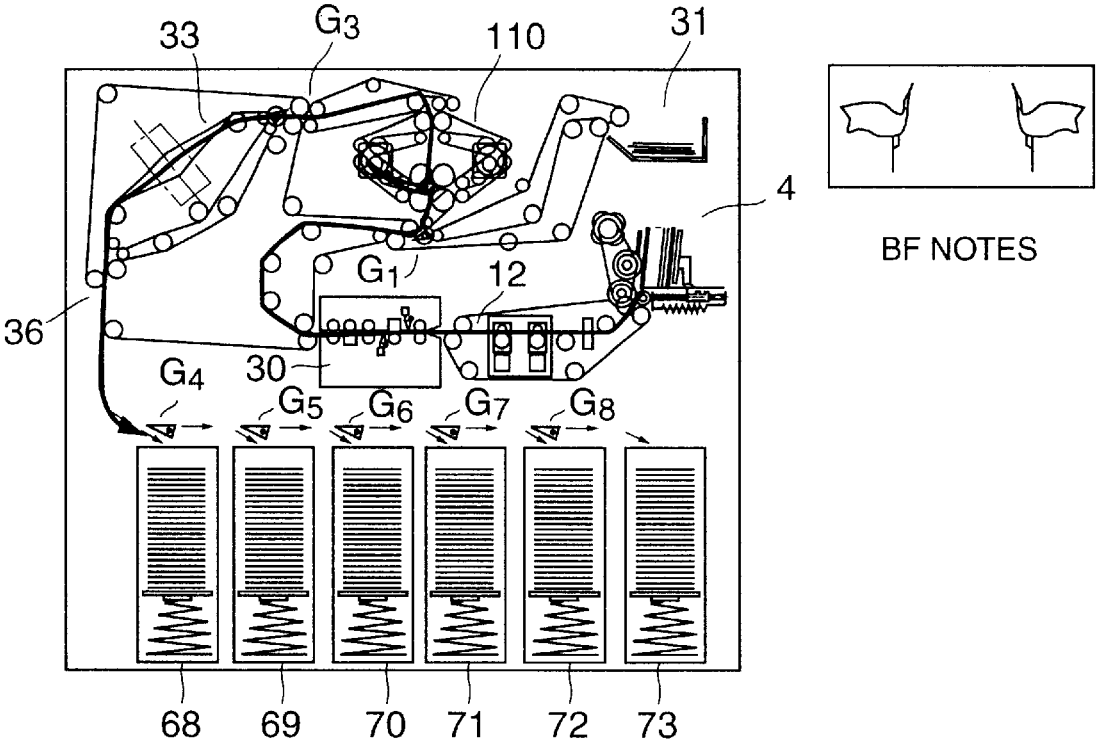
FIG. 24 is a schematic diagram showing a BF note processing route in the bank note processor shown in FIG. 21.

As shown in FIG. 24, the bank notes P taken out on the conveying path 12 from the insert port 4 and detected to be BF notes by the detector 30 are fed into the top and bottom reversing mechanism 110 through the gate G1 and the top and bottom are reversed. The bank notes P sent out of the top and bottom reversing mechanism 110 wherein the top and bottom were reversed are led to the front/back reversing mechanism 33 through the gate G3, both sides are reversed and sent out. The bank notes P sent out of the front/back reversing mechanism 33 passed the joining port 36, and sorted and stacked in the prescribed stackers 68–73 as the gates G4–G8 are selectively changed based on the result of detection in the detector 30.

Figure 25:
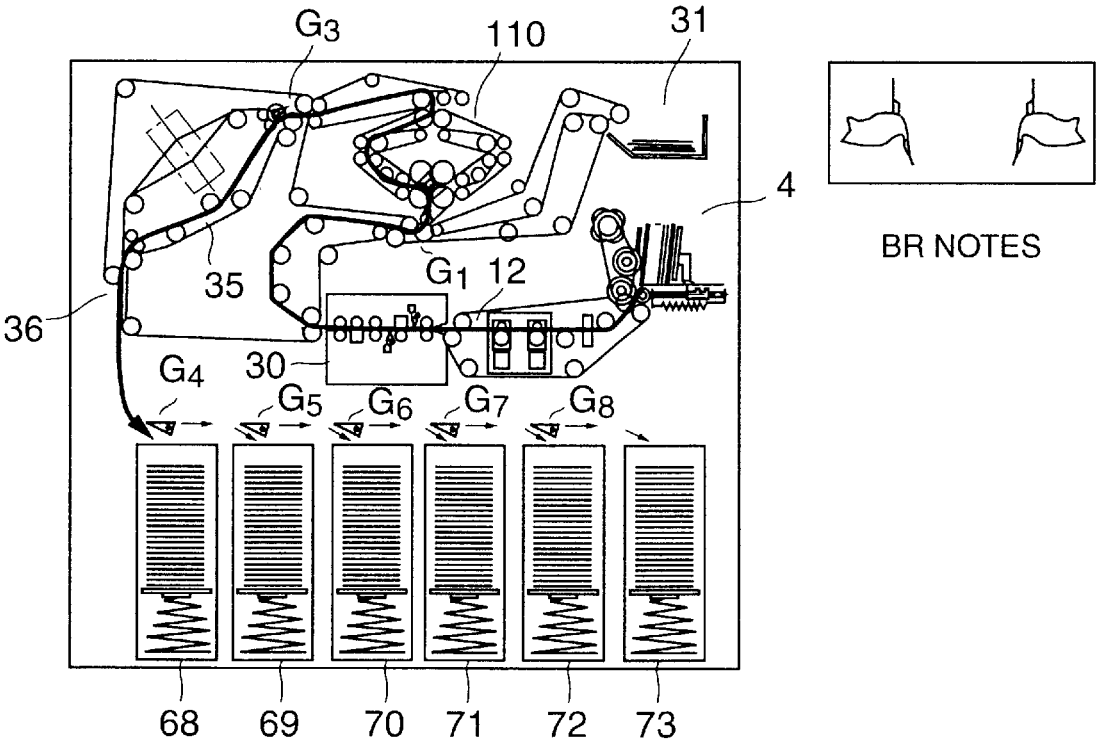
FIG. 25 is a schematic diagram showing a BR note processing route in the bank note processor shown in FIG. 21.

As shown in FIG. 25, the bank notes P taken out on the conveying path 12 from the insert port 4 and detected to be BR notes by the detector 30 pass the top and bottom reversing mechanism 110 through the gate G1 and then, pass the conveying path 35 through the gate G3 and are sorted and stacked in the prescribed stackers 68–73 as the gates G4–G8 are selective changed based on the result of detection in the detector 30.

By the way, when a bank note P taken out of the insert port 4 on the conveying path 12 is detected by the detector 30 to be excluded, this bank note to be excluded is led to the conveying path 112*b* through the gate G1 and then, discharged in the rejection box 31 provided at the end of the conveying path 112*b*.

As described above, the bank note processor 100 in the third embodiment is capable of automatically aligning the directions of the front and back sides and top and bottom sides of bank notes P inserted into the insert port 4 in the unsorted state, and automatically aligning all bank notes P in the same direction, stacking and stacking in desired stackers.

Figure 26:
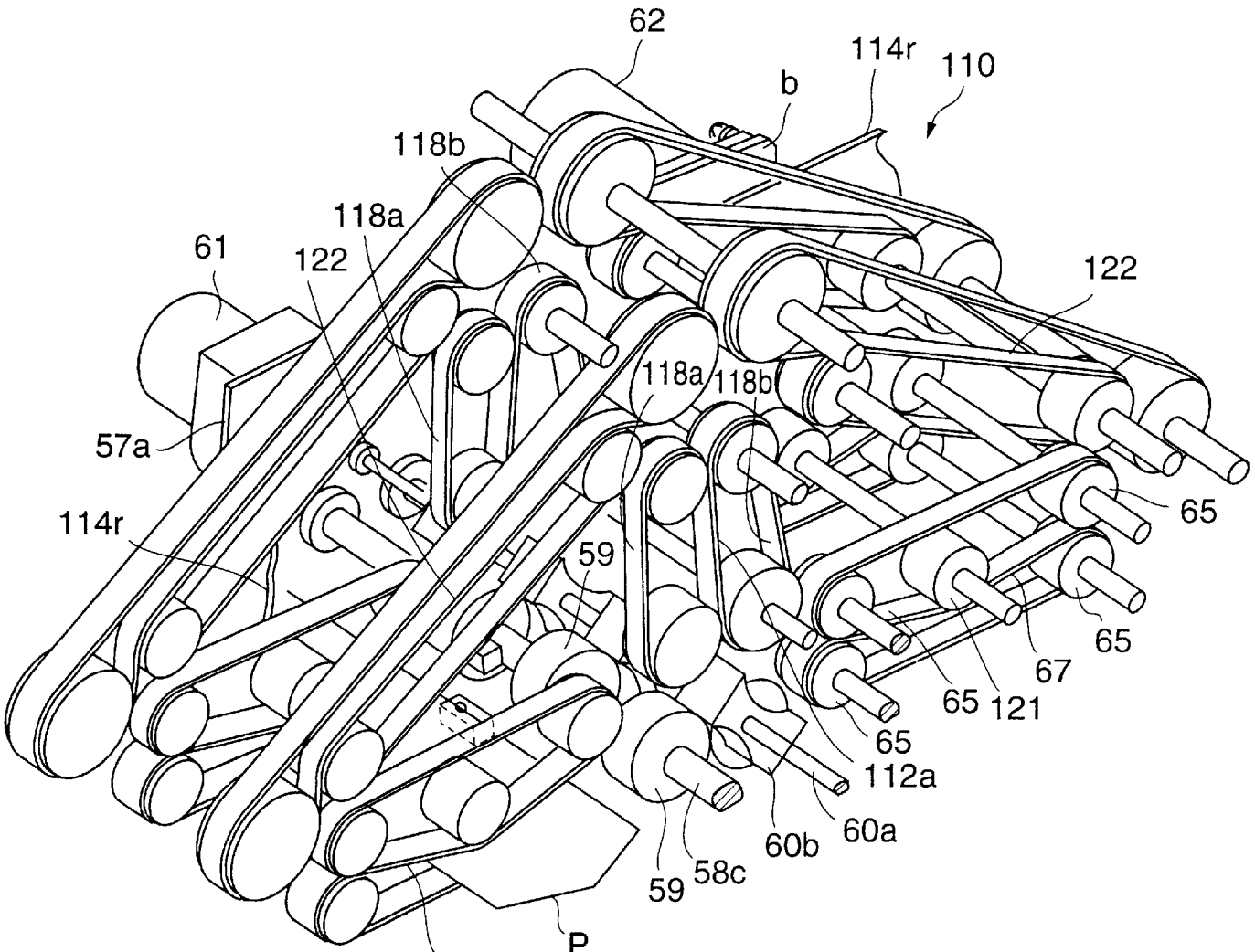
FIG. 26 is a perspective view showing the outline of the structure of the top and bottom reversing mechanism incorporated in the bank note processor shown in FIG. 21.
Figure 27:
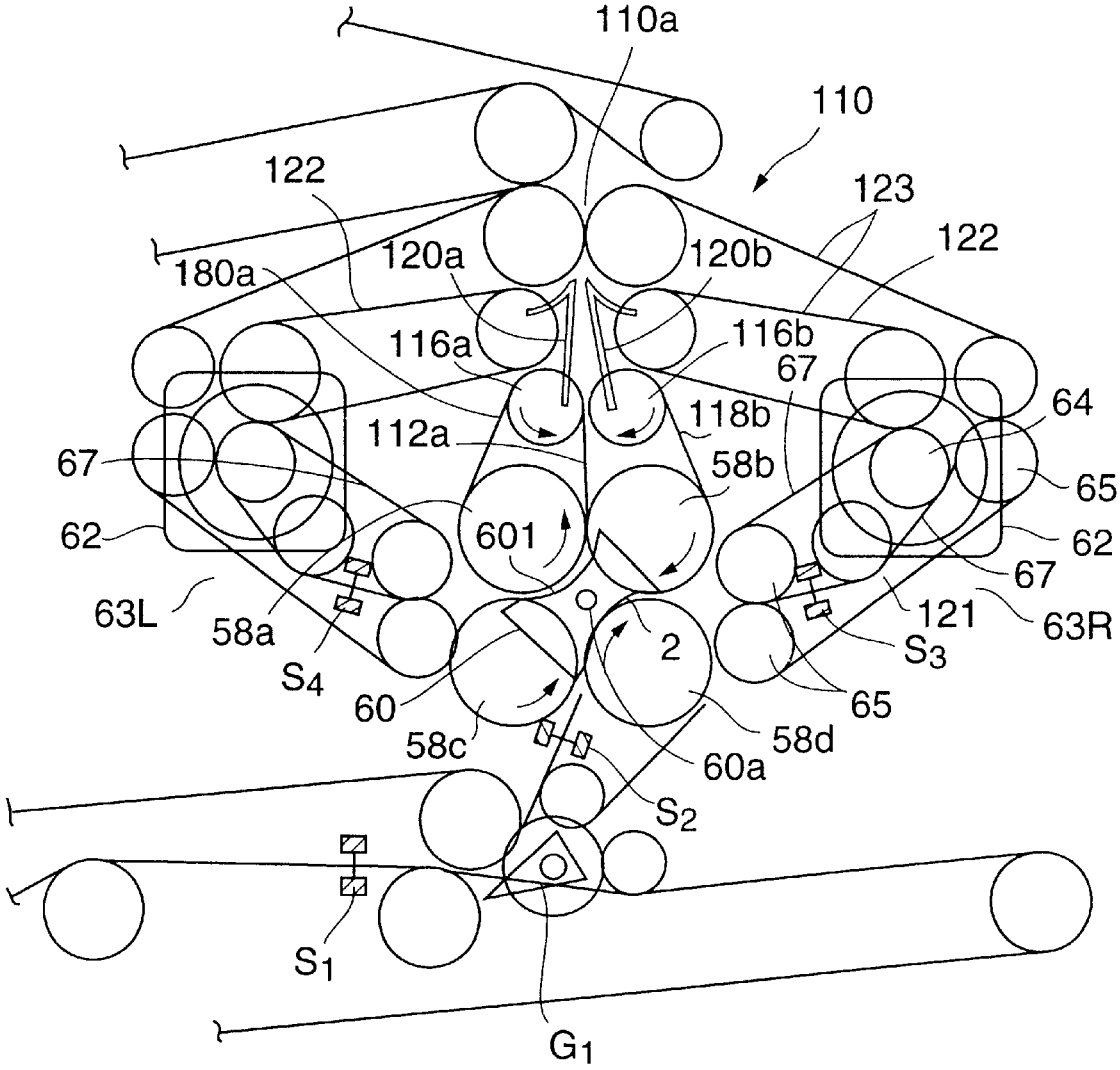
FIG. 27 is a front view of the top and bottom reversing mechanism shown in FIG. 26 viewed from the front side of the processor.

Next, the top and bottom reversing mechanism 110 is described. in detail referring to FIG. 26 and FIG. 27. FIG. 26 is a perspective view showing the rough structure of the top and bottom reversing mechanism 110 and FIG. 27 is a rough front view of the top and bottom reversing mechanism 110. Further, those portions which function similarly to the top and bottom reversing mechanism 37 in the second embodiment described above are assigned with the same reference numerals and the detailed explanations thereof are omitted here.

The top and bottom reversing mechanism 110 has the conveying path 112*a* which is extending almost vertically upward from the position branched by the gate G1 to its exit in FIG. 26. Further, the top and bottom reversing mechanism 110 has a pair of frames 114*f* and 114*r* vertically erected by separating each other at the front side and the rear side of the bank note processor 100 at the positions to clamp the conveying path 112*a* from both sides. The pair of frames 114*f* and 114*r* are arranged by separating each other at a space wider than at least the most wide bank note P that is passed through the conveying path 112*a* and fixed to the housing 2 of the bank note processor 100. Further, in FIG. 26 the front side frame 114*f* is omitted for making the illustration clear.

Between the pair of frames 114*f* and 114*r*, four conveying rollers 58*a*, 58*b*, 58*c* and 58*d* which have the rotary shafts extending from the front side to the rear side of the processor are mounted rotatably in the state closely arranged in the up-and-down and left-and-right directions. Two conveying rollers 58*a* and 58*c* are provided at the left side to the conveying path 112*a* in the figure by mutually separating upward and downward. The remaining two conveying rollers 58*c* and 58*d* are provided at the right side to the conveying path 12*a* in the figure by mutually separating upward and downward. Further, each of all rollers of the top and bottom reversing mechanism 110 explained below has a rotary shaft extending from the front side to the rear side of the processor.

There are two conveying rollers 116*a* and 116*b* provided at the separated positions above two conveying rollers 58*a* and 58*b* provided at the downstream side along the conveying path 112*a*; that is, in the upper part of FIG. 27. An endless conveyor belt 118*a* is wound round two conveying rollers 58*a* and 116*a* arranged at the left side of the conveying path 112*a*. An endless conveyor belt 118*b* is wound round two conveying rollers 58*b* and 116*b* arranged at the right side of the conveying path 112*a*. The surfaces of two conveyor belts 118*a* and 118*b* are brought in contact with each other at the position of the conveying path 112*a* and define it. Further, other two conveying rollers 58*c* and 58*d* provided in the lower part of FIG. 27 are also in contact with each other with the conveying path 112*a* put between them.

The conveying rollers 58*a*, 58*b*, 58*c*, 58*d*, 116*a* and 116*b* themselves can be driven or a driving force may be transmitted to them via a driving transmission mechanism (not illustrated). The conveying rollers 58*a*, 58*b*, 58*c*, 58*d*, 116*a* and 116*b* are rotated at a fixed velocity in the arrow direction.

Further, above two conveying rollers 116*a* and 116*b*, there are provided two guide members 120*a* and 120*b* for guiding bank papers P conveyed into the upper part of the figure passing between the conveying rollers 116*a* and 116*b* toward the exit 110*a* of the top and bottom reversing mechanism 110. These two guide members 120*a* and 120*b* are arranged at the positions to put the conveying path 112*a* between them. The guide member 120*a* and 120*b* also function as guide members to guide a bank note P that is returned to the conveying path 112*a* via a return conveying path 122, which is described later, by passing the switchback portion 63, which is described later, in the forward direction.

There is provided a guide member 60 among four conveying rollers 58*a*, 58*b*, 58*c* and 58*d*. The guide member 60 is provided for selectively guiding bank papers P conveyed through the conveying path 112*a* to two switchback portions 63L and 63R, which are described later, and for returning bank papers P accepted in the switchback portions 63L and 63R and then, sent back in the reverse direction after the switchback on the conveying path 112*a*.

A rotary shaft 60*a* of the guide member 60 is supported rotatably by bearing portions mounted to the frame pair 114*f* and 114*r*. The rear side end of the guide member 60 is extended by penetrating the bearing portion provided to the rear side frame 114*r* and is connected to a rotary solenoid 61 mounted to the rear side frame 114*r* via a supporting frame 57*a*.

Figure 28:
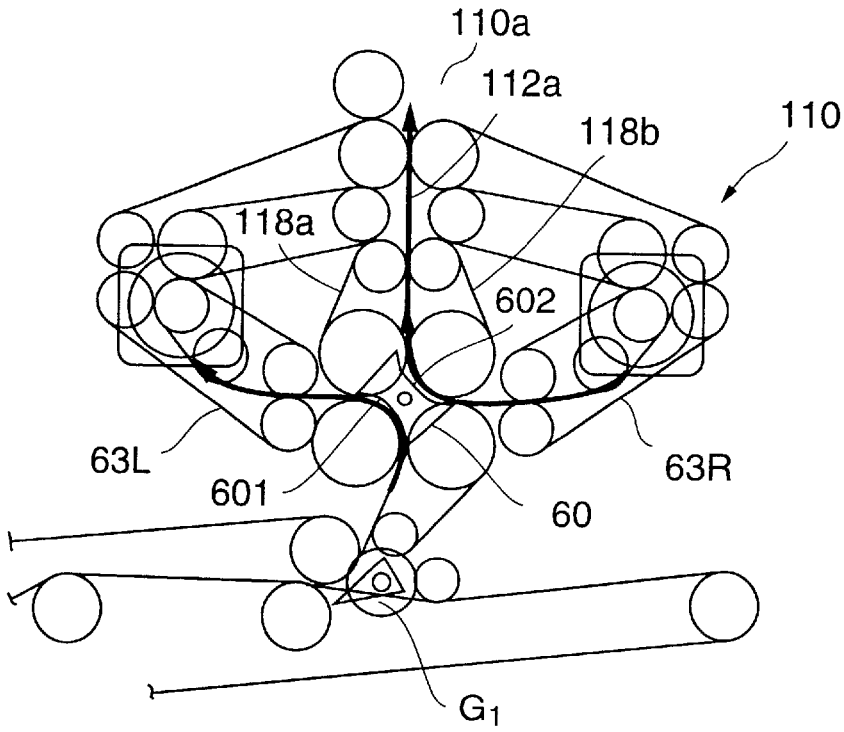
FIG. 28 is a diagram for explaining the bank note switchback operation by the top and bottom reversing mechanism shown in FIG. 27.
Figure 29:
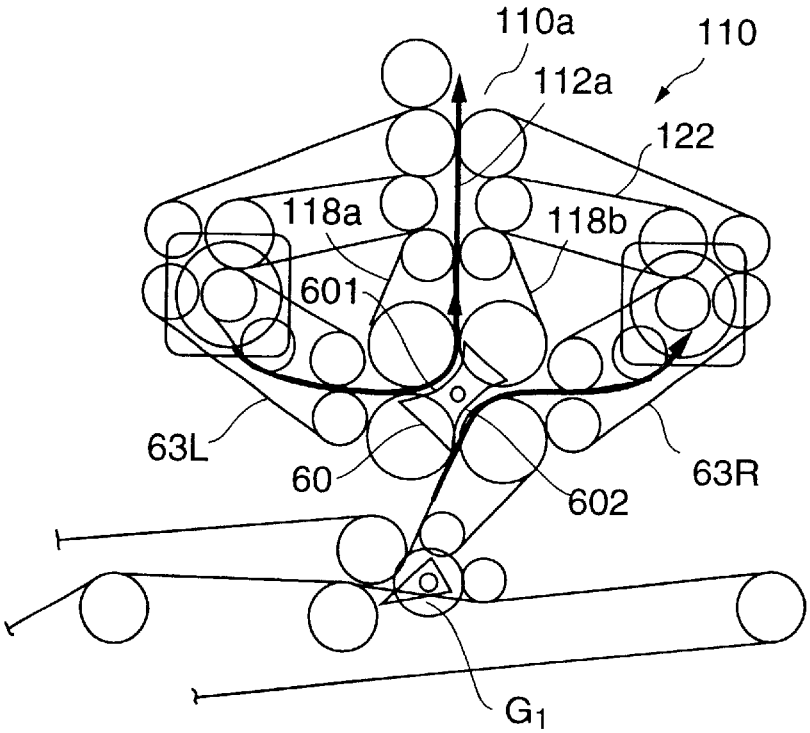
FIG. 29 is a diagram for explaining the bank note switchback operation.

A gate block 60*b* of the guide member 60 is able to rotate (move) between the rotary position where it becomes a posture shown in FIG. 28 and the rotary position where it becomes a posture shown in FIG. 29 when the rotary solenoid 61 is driven to rotate in the forward and reverse directions by 90° by the guide member 60.

At the right and left sides of four conveying rollers 58*a*, 58*b*, 58*c* and 58*d*, the switchback portions 63 are provided for reversing the top and bottom; that is, the conveying direction of bank papers P. The switchback portions 63L and 63R are formed symmetrically and are nearly in the same structure and therefore, the switchback portion 63 at the right side is explained as a representative and the detailed explanation of the left side switchback portion 63L is omitted here.

The switchback portion 63R has one driving roller 64, three driven rollers 65 and one guide roller 121. The guide roller 121 which is provided in addition to the structure in the second embodiment functions to slightly bend the conveying route of bank paper P upward to direct the bank paper accepted in the switchback portion 63R upward in the diagram. That is, the guide roller 121 is arranged in the inside of a belt wound round the driving roller 64 and one driven roller 65 and curve the conveying route of the bank note P by pushing the back of the belt downward in the diagram.

Both ends of the rotary shafts of the rollers 64, 65 and 121 are supported to the frame pair 114*f* and 114*r* rotatably via the bearing portions. The rear side end of the driving roller 64 is extending by penetrating the rear side frame 114*r* and is connected directly to the rotary shaft of a motor 62 mounted to the frame 114*r* via a supporting frame 57*b*. The motor 62 is capable of rotating in the forward and reverse directions and its rotary velocity is also controllable high precisely.

For example, the motor 62 of the switchback portion 63R is rapidly decelerated to a zero speed from the state wherein it is rotating at a fixed speed in the direction to accept a bank note P, that is, in the forward direction. Thereafter, the motor 62 is rapidly accelerated in the reverse direction to the original speed and is rotated to send out the bank note P accepted in the switchback portion 63 in the reverse direction after the switchback in the clamped stated. Further, after accepting a bank note P in the switchback portion 63R, the motor 62 continues to rotate without stopping to send out the bank note P accepted in the switchback portion 63R in the forward direction.

The bank note P sent out in the forward direction from the switchback portion 63R is returned on the conveying path 112*a* via the return conveying path 122 which is extending toward the exit 110*a* of the top and bottom reversing mechanism 110. The return conveying path 122 is defined by contacting the surface of an endless belt 123 wound round the roller pair and sends out the bank note P in the clamped state toward the exit 110*a* by rotating the rollers in the prescribed direction by a motor (not shown).

Further, the top and bottom reversing mechanism 110 has four sensors S1, S2, S3 and S4 arranged to acquire the operating timings of the gate G1, the rotary solenoid 61 and the motor 62 described above as shown in FIG. 27. Each of these sensors is of transmission type equipped with a photodiode and an LED and detects the passage of a bank note as the optical axis is cut off when a bank note passes. The sensor S1 is provided at the upper stream side of the gate G1 and detects the arrival of a bank note. The sensor S2 is provided on he conveying path 112*a* between the gate G1 and the guide member 60 and gets the operation timing of the rotary solenoid 61. The sensors S3 and S4 are provided at a place near the entrance in the left and right switchback portions 63L and 63R, respectively and get the operation timing of the motor 62 of each switchback portion 63.

Here, the operation of the top and bottom reversing mechanism 110 in the structure as described above is explained. Further, bank notes which do not require the top and bottom reversion as well as those requiring the top and bottom reversion are fed into the top and bottom reversing mechanism of this embodiment as described above.

When a bank note P of which top and bottom is detected to be reversed is led into the top and bottom reversing mechanism 110 through the gate G1, for example, the guide member 60 is rotated to the posture shown in FIG. 28. As a result, the fed bank note is guided to the left side switchback portion 63L via the guide surface 601. When another bank note P is accepted in the right side switchback portion at this time, this bank note P is returned on the conveying path 112*a* via the guide surface 602 of the guide member 60.

Hereafter, when a next bank note of which top and bottom are detected to be reversed is fed into the top and bottom reversing mechanism 110 through the gate G1, the guide member 60 is rotated to the posture shown in FIG. 29. As a result, the second sheet of bank note is guided to the right side switchback portion 63R via the guide surface 602. At the same time, the first sheet of bank note accepted in the left side switchback portion 36L is returned on the conveying path 112*a* via the guide surface 601. By repeating the above operations successively, the tops and bottoms of plural sheets of bank notes are reversed successively.

Figure 30:
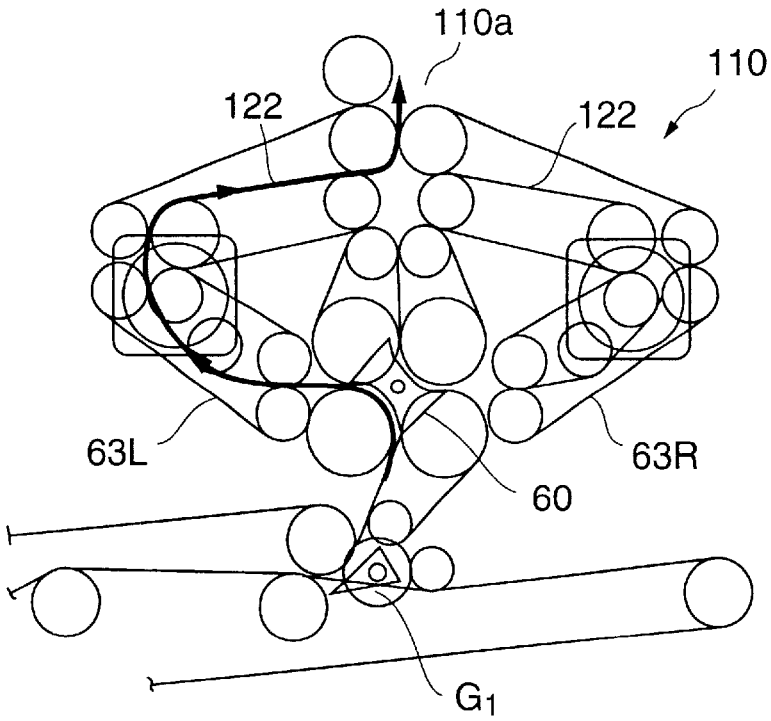
FIG. 30 is a diagram for explaining the operation not to reverse the top and bottom of a bank note in the top and bottom reversing mechanism shown in FIG. 27.

On the other hand, when a bank note P detected that its top and bottom should not be reversed by the detector 30 is led to the top and bottom reversing mechanism 110 via the gate G1, the guide member 46 is rotated to, for example, a posture shown in FIG. 30, and the bank note P Is guided to the left side switchback portion 63. At this time, the motor 62 of the left side switchback portion 63L is continuously rotated in the forward direction and the bank note P is sent out in the forward direction to the exit 110*a* of the top and bottom reversing mechanism 110 through the left side return conveying path 122 without reversing its top and bottom.

Figure 31:
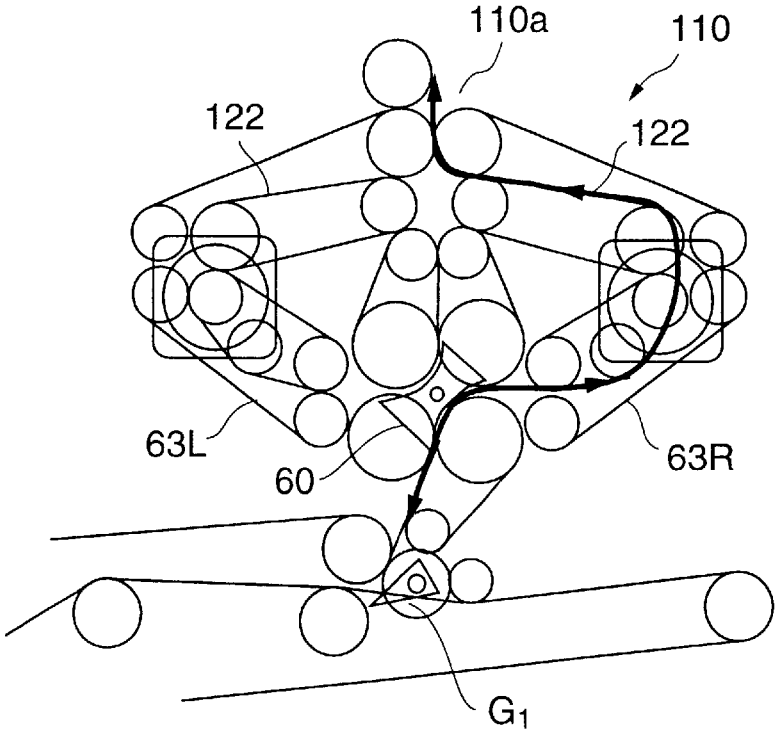
FIG. 31 is a diagram for explaining the operation not to reverse the top and bottom of a bank note in the top and bottom reversing mechanism shown in FIG. 27.

Hereafter, when next bank note P of which top and bottom should not be reversed is fed into the top and bottom reversing mechanism 110 through the gate G1, the guide member 60 is rotated to the posture shown in FIG. 31 and the second sheet of bank note P is guided to the right side switchback portion 63R. Or the second sheet of bank note P is guided to the left side switchback portion 63L in the state where the guide member 60 has been rotated to the posture shown in FIG. 30. At this time, the motor of the right side (or the left side) switchback portion 63R (or 63L) continuously rotates in the forward direction and the second sheet of bank note P is sent out in the forward direction toward the exit 110*a* of the top and bottom reversing mechanism 110 through the right side (or the left side) return conveying path 122 without reversing its top and bottom.

Further, for example, when a bank note P which requires the reversing of the top and bottom is passed through the left side switchback portion 63L in the state the guide member 60 is rotated to the posture shown in FIG. 30, it is possible to send out a bank note P accepted in the right side switchback portion 63R and of which top and bottom is to be reversed to the conveying path 112*a*. The lengths and conveying speeds of the conveying routes are so set that in either case, all bank notes P fed into the top and bottom reversing mechanism 110 via the gate G1 pass through the exit 110*a* of the top and bottom mechanism 110 in the same time.

As described above, according to the top and bottom reversing mechanism 110 of this embodiment, when reversing the top and bottom of a bank note P, the movement of a bank note accepted in the switchback portion 63 is once stopped by decelerating the conveying speed in the clamped state and then, accelerated in the reverse direction and the bank note is taken out and returned on the conveying path 112*a* as in the top and bottom reversing mechanism in the second embodiment described above. It is therefore not required to stop the conveyance of a bank note by striking its tip against a stopper as in a conventional switchback mechanism, and the switchback can be made surely and stably without causing such defects as buckling, bending or breaking of the tip of a bank note even if it is weak in stiffness.

Further, according to the top and bottom reversing mechanism 110 in this embodiment, bank notes P which are accepted in the switchback portions 63*d*L and 63R and not requiring the reverse of the top and bottom can be passed in the forward direction in the state without reversing the top and bottom, and therefore, a bypass conveying path is not required for bypassing the bank notes P not requiring the reverse of th top and bottom as in the second embodiment. In other words, the gate G2 and the conveying path from the gate G2 to the joining portion 54, which are required in the second embodiment become unnecessary. Accordingly, such components as the conveying belt, conveying rollers, conveying guides, gate G2, etc. becomes unnecessary and the system construction can be simplified and a system manufacturing cost can be reduced. Further, as a bypass conveying path is not required, it is not necessary to convey bank notes P for an unnecessarily long distance. In addition, the number of times to pass the curved regions of the conveying path is reduced, a ratio of conveying jam generation can be lowered and reliability of the system can be increased.

Further, in the above third embodiment, the selective sorting of bank notes fed through the conveying path 112*a* into two switchback portions 63L and 63R is described but more than three switchback portions 51 may be usable.

As the paper-like meterial processing apparatus of the present invention is in the construction and has functions as described above, the directions of the both sides and the top and bottom of all bank notes are automatically aligned in the same direction and sorted and stacked.

Further, the switchback mechanism and the sheet processing apparatus equipped with this switchback mechanism are in the construction and have functions as described above, it is possible to switch back sheets certainly and safely and process a number of sheets continuously at a high speed and promote efficiency of process.

What is claimed is:

1. A paper-like material processing apparatus comprising:

an insert port into which plural paper-like materials are inserted in a lump;

a detector to detect the directions of front and back and top and bottom of paper-like materials that are conveyed one paper-like material at a time; and an aligning mechanism to align the front and back, and top and bottom of conveyed paper-like materials in the same direction based on the result of detection by the detector.

2. A paper-like material processing apparatus according to claim 1, further comprising:

stackers to sort and stack the paper-like materials which are aligned in the same direction by the aligning mechanism.

3. A paper-like material processing apparatus according to claim 1, wherein the aligning mechanism includes:

a front and back reversing mechanism to selectively reverse the front and back of the paper-like materials being conveyed; and a top and bottom reversing mechanism to selectively reverse the top and bottom of the paper-like materials being conveyed.

4. A paper-like material processing apparatus according to claim 1, further comprising:

a correction mechanism to correct the conveying posture of the paper-like materials being conveyed.

5. A paper-like material processing apparatus according to claim 4, wherein the correction mechanism is arranged on a conveying path between the insert port and the detector.

6. A paper-like material processing apparatus according to claim 4, wherein the correction mechanism comprises:

at least a pair of correction rollers arranged opposing to push against each other with the conveying path put between them, these correction rollers generate a conveying force to convey a paper-like material clamped between them along the conveying path; and a rotating mechanism to rotate the correction rollers centering around rotary shafts which are extended in the surface direction of paper-like materials conveyed along the conveying path, the rotating mechanism sets the correction rollers at desired rotating positions before a paper-like material is conveyed and by tilting the paper-like material conveying direction by the correction rollers, corrects the positional shift along the cross direction crossing the paper-like material conveying direction and/or corrects the angular shift of a paper-like material by rotating the correction rollers in a desired direction in the state clamping a paper-like material.

7. A paper-like material processing apparatus according to claim 4, wherein the correction mechanism comprises:

a pair of first correction rollers arranged opposing to push against each other with the conveying path put between them;

a first rotating mechanism to rotate the first correction rollers centering around first rotary shafts which are extended in the face direction of a paper-like material being conveyed along the conveying path, the first rotating mechanism sets the first correction rollers at desired rotating positions before a paper-like material is conveyed and by tilting the paper-like material conveying direction by the first correction rollers, corrects the positional shift along the cross direction crossing the paper-like material conveying direction;

a pair of second correction rollers arranged opposing to push against each other with the conveying path put between them; and a second rotating mechanism to rotate the second correction rollers centering around the second rotary shafts which are extended in the face direction of a paper-like material being conveyed, the second rotating mechanism corrects the angular shift of a paper-like material by rotating the second correction rollers in a desired direction in the state clamping a paper-like material between them.

8. A paper-like material processing apparatus comprising:

an insert port into which plural paper-like materials in different sizes are inserted in a lump;

a correction mechanism to correct the conveying posture of the paper-like material conveyed one paper-like material at a time from the insert port through a conveying path, the correction mechanism including:

at least a pair of correction rollers arranged opposing to push against each other with the conveying path put between them, the correction rollers generate a conveying force for conveying the paper-like material clamped between them along the conveying path; and a rotating mechanism to rotate the correction rollers centering around rotary shafts that are extended in the face direction of a paper-like material conveyed along the conveying path, the rotating mechanism sets the correction rollers at desired rotating positions before the paper-like material is conveyed and by tilting the conveying direction of the paper-like material by the correction roller, corrects the positional shift of a paper-like material along the cross direction crossing the paper-like material conveying direction and/or corrects the angular shift of the paper-like material by rotating the correction rollers in the desired direction in the state clamping the paper-like material between them;

a detector to detect the front and back of the paper-like material being conveyed; and a reversing mechanism to selectively reverse the fronts and backs of paper-like materials being conveyed based on the result of detection by the detector and align the direction of paper-like materials in the same direction.

9. A paper-like material processing apparatus according to claim 8, further comprising:

stackers to sort and stack paper-like materials that are aligned in the same direction by the reversing mechanism.

10. A paper-like material processing apparatus according to claim 8, wherein the correction mechanism is arranged on a conveying path between the insert port and the detector.

11. A paper-like material processing apparatus comprising:

an insert port into which plural paper-like materials in different sizes are inserted in a lump;

a correction mechanism to correct the conveying posture of the paper-like material conveyed one paper-like material at a time from the insert port through a conveying path, the correction mechanism including:

a pair of first correction rollers arranged opposing to push against each other with the conveying path put them;

a first rotating mechanism to rotate the first correction rollers centering around first rotary shafts that are extended in the face direction of a paper-like material being conveyed along the conveying path, the first rotating mechanism sets the first correction rollers at desired rotating positions before a paper-like material is conveyed and by tilting the conveying direction of a paper-like material by the first correction rollers, corrects the positional shift of a paper-like material along the cross direction crossing the conveying direction of the paper-like material;

a pair of second correction rollers provided separating each other at the downstream side in the conveying direction of the first correction rollers and arranged opposing to push against each other with the conveying path put between them; and a second rotating mechanism to rotate the second correction rollers centering around second rotary shafts which are extended in the face direction of a paper-like material, the second rotating mechanism corrects the angular shift of a paper-like material by rotating the second correction rollers in the state clamping a paper-like material between them in a desired direction;

a detector to detect the front and back of the paper-like material being conveyed; and a reversing mechanism to selectively reverse the fronts and backs of paper-like materials being conveyed based on the result of detection by the detector and align the direction of paper-like materials in the same direction.

12. A paper-like material processing apparatus comprising:

an insert port into which paper-like materials are inserted;

a correction mechanism to correct the conveying posture of the paper-like materials that are conveyed one paper-like material at a time through a conveying path from the insert port; and a detector to detect features of the paper-like material of which conveying posture is corrected by the correction mechanism, wherein the correction mechanism comprises:

at least a pair of correction rollers arranged opposing to push against each other with the conveying path put between them, the correction rollers generate a conveying force for conveying the paper-like material clamped between them along the conveying path; and a rotating mechanism to rotate the correction rollers centering around rotary shafts that are extended in the face direction of the paper-like material conveyed along the conveying path, the rotating mechanism sets the correction rollers at desired rotating positions before the paper-like material is conveyed and by tilting the paper-like material conveying direction by the correction rollers, corrects the positional shift of the paper-like material along the cross direction crossing the paper-like material conveying direction and/or corrects the paper-like material angular shift by rotating the correction rollers in the state with a paper-like material clamped between them.

13. A paper-like material processing apparatus comprising:

an insert port into which paper-like materials are inserted;

a correction mechanism to correct the conveying posture of the paper-like materials that are conveyed one paper-like material at a time through a conveying path from the insert port, the correction mechanism including:

a pair of first correction rollers arranged opposing to push against each other with the conveying path put between them;

a first rotating mechanism to rotate the first correction rollers centering around first rotary shafts that are extended in the face direction of the paper-like material conveyed along the conveying path, the first rotating mechanism sets the first correction rollers at desired rotating positions before the paper-like material is conveyed and by tilting the paper-like material conveying direction by the first correction rollers, corrects the positional shift along the cross direction crossing the paper-like material conveying direction;

a pair of second correction rollers arranged opposing to push against each other with the conveying path put between them and a second rotating mechanism to rotate the second correction rollers centering around the second rotary shafts extended in the face direction, the second rotating mechanism corrects the paper-like material angular shift by rotating the second correction rollers in a desired direction in the state with a paper-like material clamped between them;

a detector to detect features of the paper-like material of which conveying posture is corrected by the correction mechanism.

14. A switchback mechanism comprising:

a conveying path to convey paper-like materials in a fixed direction;

first and second switchback portions provided along the conveying path for reversing the top and bottom of a paper-like material by accepting the paper-like material conveyed through the conveying path and sending the paper-like material in the reverse direction; and a guide member to accept the paper-like materials conveyed through the conveying path in the first switchback portion and the second switchback portion selectively.

15. A switchback mechanism according to claim 14, wherein the guide member is provided movable between a first position wherein paper-like materials being conveyed through the conveying path can be guided to the first switchback portion and the paper-like materials accepted in the second switchback portion can be sent out on the conveying path and a second position wherein paper-like materials being conveyed through the conveying path can be guided to the second switchback portion and the paper-like materials accepted in the first switchback portion can be sent out on the conveying path.

16. A switchback mechanism according to claim 14, wherein the first and second switchback portions reverse the top and bottom of an accepted paper-like material by decelerating and stop the conveyance of the paper-like material in the state clamping the paper-like material between them and accelerating and sending the paper-like material out in the reverse direction.

17. A switchback mechanism according to claim 14, wherein the first and second switchback portions are able to reverse the top and bottom of an accepted paper-like material by decelerating and stopping the conveyance of an accepted paper-like material and then, accelerating and sending the paper-like material out in the reverse direction when reversing the top and bottom of the paper-like material, and are able to send out the paper-like material without stopping the paper-like material in the state clamping the paper-like material when the reversion is not required.

18. A switchback mechanism comprising:

a conveying path to convey paper-like materials in a fixed direction;

first and second switchback portions provided along the conveying path for reversing the top and bottom of a paper-like material by accepting the paper-like material conveyed through the conveying path and sending the paper-like material in the reverse direction; and a guide member to accept the paper-like materials conveyed through the conveying path in the first switchback portion and the second switchback portion selectively, the guide member being provided movable between a first position wherein paper-like materials being conveyed through the conveying path can be guided to the first switchback portion and the paper-like materials accepted in the second switchback portion can be sent out on the conveying path and a second position wherein paper-like materials being conveyed through the conveying path can be guided to the second switchback portion and the paper-like materials accepted in the first switchbackportion can be sent out on the conveying path, and the guide member including:

a first guide surface to guide the paper-like material being conveyed through the conveying path in the state moved to the first position and guide the paper-like material accepted in the first switchback portion to the conveying path in the state moved to the second position; and a second guide surface to guide the paper-like material being conveyed through the conveying path to the second switchback portion in the state moved to the second position and guide the paper-like material accepted in the second switchback portion to the conveying path in the state moved to the first position.

19. A switchback mechanism comprising:

a conveying path to convey paper-like materials in a fixed direction;

first and second switchback portions provided along the conveying path for reversing the top and bottom of a paper-like material by accepting the paper-like material conveyed through the conveying path and sending the paper-like material in the reverse direction; and a guide member to accept the paper-like materials conveyed through the conveying path in the first switchback portion and the second switchback portion selectively, the guide member being provided movable between a first position wherein paper-like materials being conveyed through the conveying path can be guided to the first switchback portion and the paper-like materials accepted in the second switchback portion can be sent out on the conveying path and a second position wherein paper-like materials being conveyed through the conveying path can be guided to the second switchback portion and the paper-like materials accepted in the first switchback portion can be sent out on the conveying path, and the guide member including:

a first guide surface to guide the paper-like materials being conveyed through the conveying path to the first switchback portion in the state moved to the first position and guide the paper-like material being conveyed on the conveying path to the second switchback portion in the state moved to the second position and a second guide surface to guide the paper-like material accepted in the second switchback portion to the conveying path in the state moved to the first position and guide the paper-like material accepted in the first switchback portion to the conveying path in the state moved to the second position.

20. A switchback mechanism comprising:

a conveying path to convey paper-like materials in the fixed direction and a switchback portion which is provided along the conveying path, accept paper-like material conveyed through the conveying path, decelerate and stop the accepted paper-like material in the state with the paper-like material clamped between a pair of belts and send out the paper-like material by accelerating in the reverse direction, thereby reversing the top and bottom of the paper-like material.

21. A switchback mechanism according to claim 20, further comprising:

a guide member to selectively accept the paper-like material being conveyed through the conveying path in the switchback portions.

22. A switchback mechanism according to claim 20, wherein the switchback portion send out the paper-like material in the forward direction toward to the conveying path without stopping the paper-like material when its top and bottom are not reversed.

23. A paper-like material processing apparatus comprising:

a take-out portion to take out paper-like materials;

a main conveying path to convey the paper-like materials taken out by the take-out portion in a fixed direction;

a detector to detect features of the paper-like materials being conveyed through the main conveying path from the take-out portion a switchback mechanism to selectively reverse the top and bottom of the paper-like materials based on the result of detection in the detector, the switchback mechanism configured to accept paper-like material conveyed through the main conveying path, decelerate and stop the accepted paper-like material in the state with the paper-like material clamped between a pair of belts and send out the paper-like material by accelerating in the reverse direction;

a bypass conveying path to bypass the paper-like materials passed through the detector without sending to the switchback mechanism and a discharge portion provided at a position branched from the bypass conveying path to discharge a paper-like material that is judged to be excluded by the detector and led to the bypass conveying path.

24. A paper-like material processing apparatus comprising:

a take-out portion to take out paper-like materials;

a conveying path to convey the paper-like materials taken out by the take-out portion in a fixed direction;

a first and second switchback portions provided along the conveying path to reverse the tops and bottoms of the paper-like materials conveyed through the conveying path from the take-out portion by accepting them and sending out in the reverse direction; and a guide member to selectively accept paper-like materials being conveyed through the conveying path in the first switchback portion and the second switchback portion.

25. A paper-like material processing apparatus according to claim 24, further comprising:

a detector to detect paper-like materials being conveyed in a fixed direction through the conveying path from the take-out portion;

wherein the guide member guides the paper-like materials to either the first switchback portion or the second switchback portion based on the result of detection in the detector.

26. A paper-like material processing apparatus according to claim 24, wherein the guide member is movable between a first position wherein it is possible to guide the paper-like materials being conveyed through the conveying path to the first switchback portion and to send out the paper-like materials accepted in the second switchback portion to the conveying path and a second position wherein it is possible to guide the paper-like materials being conveyed through the conveying path to the second switchback portion and to send out the paper-like materials accepted in the first switchback portion to the conveying path.

27. A paper-like material processing apparatus according to claim 26, wherein the guide member includes:

a first guide surface to guide the paper-like materials being conveyed through the conveying path to the first switchback portion in the state moved to the first position and guide the paper-like materials accepted in the first switchback portion to the conveying path in the state moved to the second position; and a second guide surface to guide the paper-like materials being conveyed through the conveying path to the second switchback portion in the state moved to the second position and guide the paper-like materials accepted in the second switchback portion to the conveying path in the state moved to the first position.

28. A paper-like material processing apparatus according to claim 27, wherein the guide member includes:

a first guide surface to guide the paper-like materials being conveyed through the conveying path to the first switchback portion in the state moved to the first position and guide the paper-like materials being conveyed through the conveying path to the second switchback portion in the state moved to the second position; and a second guide surface to guide the paper-like materials accepted in the second switchback portion to the conveying path in the state moved to the first position and guide the paper-like materials accepted in the first switchback portion to the conveying path in the state moved to the second position.

29. A paper-like material processing apparatus according to claim 24, wherein the first and the second switchback portions reverse the top and bottom of a paper-like material by decelerating and stopping the accepted paper-like material in the state clamping the accepted paper-like material and thereafter, accelerating and sending out it in the reverse direction.

30. A paper-like material processing apparatus according to claim 24, wherein the first and the second switchback portions are able to reverse the top and bottom of the paper-like material by decelerating and stopping in the state clamping the paper-like material and then, accelerating and sending the paper-like material out in the reverse direction when reversing its top and bottom, and send out an accepted paper-like material in the clamped state without stopping when not reversing the top and bottom of the paper-like material.

31. A paper-like material processing apparatus comprising:

a take-out portion to take out paper-like materials;

a conveying path to convey the paper-like materials taken out by the take-out portion in a fixed direction a detector to detect the paper-like materials being conveyed through the conveying path;

a guide member provided along the conveying path and guide the paper-like materials conveyed through the conveying path in the direction out of the conveying path based on the result of detection of the detector; and a switchback portion to decelerate and stop the paper-like material, which is guided through the guide member, in the state with the paper-like material clamped between a pair of belts and then, accelerate and send out the paper-like material in the reverse direction toward the conveying path.

32. A paper-like material processing apparatus comprising: a take-out portion to take out paper-like materials;

a conveying path to convey the paper-like materials taken out by the take-out portion;

a detector to detect the paper-like materials being conveyed through the conveying path; and a switchback portion provided along the conveying path to accept paper-like materials conveyed through the conveying path and when reversing the tops and bottoms of the paper-like materials based on the result of detection by the detector, stop the paper-like materials once in the state with the paper-like material clamped between a pair of belts and send out in the reverse direction toward the conveying path, and send out the paper-like materials to the conveying path without stopping the paper-like materials when not reversing the tops and bottoms of the paper-like materials.

* * * * *